United States Patent [19]

Kusunose et al.

[11] 4,107,374

[45] Aug. 15, 1978

[54] NON-WOVEN FABRIC USABLE AS A SUBSTRATUM SHEET FOR ARTIFICIAL LEATHER

[75] Inventors: Tetsuhiro Kusunose; Tsukasa Shima; Hiroshi Henmi; Sadahiko Yasui, all of Nobeoka, Japan

[73] Assignee: Asahi Kasei Kogyo Kabushiki Kaisha, Osaka, Japan

[21] Appl. No.: 612,504

[22] Filed: Sep. 11, 1975

[51] Int. Cl.[2] ..... D04H 1/58

[52] U.S. Cl. ..... 428/288; 428/290; 428/295; 428/296; 428/297; 428/303; 428/904

[58] Field of Search ..... 156/148, 167, 306; 428/296, 297, 300, 303, 904, 222, 299, 288, 294, 290, 295; 264/103, 168, 188

[56] References Cited

U.S. PATENT DOCUMENTS

| | | | |
|---|---|---|---|
| 3,554,854 | 1/1971 | Hartmann | 264/75 |
| 3,705,226 | 12/1972 | Okamoto | 428/904 |
| 3,706,613 | 12/1972 | Toki et al. | 156/280 |
| 3,716,614 | 2/1973 | Okamoto | 264/344 |
| 3,914,501 | 10/1975 | Miller | 428/904 |
| 3,932,687 | 1/1976 | Okamoto | 428/904 |

OTHER PUBLICATIONS

"Superfine Thermoplastic Fibers", Wente, vol. 48, No. 8, Aug. 1956.

*Primary Examiner*—James J. Bell
*Attorney, Agent, or Firm*—Burgess, Dinklage & Sprung

[57] ABSTRACT

A non-woven fabric usable as a substratum sheet for artificial leather having a relatively high flexural rigidity is prepared by a process in which fibrous bundles, each consisting of a plurality of extremely fine filaments or fibers having a denier of 0.005 to 0.5, is provided while allowing the filaments or fibers to spontaneously adhere to each other without using an adhesive, the fibrous bundles are massed into the form of sheet or web, and the sheet or web is then subjected to a non-woven fabric forming operation in which the fibrous bundles are entangled with each other.

8 Claims, 24 Drawing Figures

NON-WOVEN FABRIC USABLE AS A SUBSTRATUM SHEET FOR ARTIFICIAL LEATHER

Figure 1:
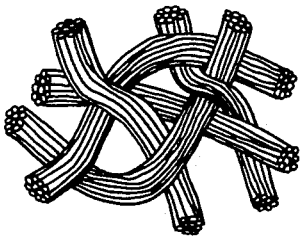

The present invention relates to a non-woven fabric and a process for producing the same. More particularly, the present invention concerns a non-woven fabric usable as a substratum sheet for artificial leather and a process for producing the same.

Generally speaking, artificial leather is composed of a substratum sheet consisting of a non-woven fabric or a woven or knitted fabric which is impregnated with an elastic polymer material, for example, polyurethane.

In order to produce a non-woven fabric usable as the substratum sheet for artificial leather, numerous natural fibers, for example, cotton and wool; regenerated cellulose fibers, for example, cuprammonium rayon and viscose rayon; or synthetic fibers, for example, a polyamide fibers, are webbed by means of a carding engine, a cross layer and/or a random webber, and the web is needle punched so as to entangle the fibers with each other. The resultant non-woven fabric is further treated with an adhesive to dimensionally stabilize it.

It is known that since individual fibers are adhered to each other with adhesive, the conventional non-woven fabric has a relatively high flexural rigidity and dimensional stability. However, this type of non-woven fabric has a poor softness and bulkiness and feels like paper.

It is also known that the fibers used for the conventional non-woven fabric are quite different in their properties and configuration from those of the fibrous collagen of which the natural leather is composed. Therefore, conventional artificial leather is considerably different in its properties from natural leather.

Japanese patent application publication No. 24699/1969 discloses an attempt to provide an artificial leather having properties and configuration similar to those of natural leather. In this disclosure, a non-woven fabric is produced from numerous fibrous bundles, each consisting of a plurality of individual fibers. The fiber bundles are sized with a sizing agent in order to adhere the individual fibers to each other. The sized fibrous bundle is cut into a predetermined length. The cut fibrous bundles are converted into a web by the aforementioned method. The resultant web is needle-punched. The resultant non-woven fabric is impregnated with an elastic polymeric binder other than the sizing agent, after which said sizing agent is removed from said non-woven fabric. An artificial leather is obtained.

After the sizing agent is removed from said non-woven fabric, the individual fibers are separated from each other and are quite free in their relative movement to each other. Accordingly, in this type of the artificial leather, the fibrous bundles have a very small flexural rigidity and, thus, the artificial leather is very soft. From this fact, it is obvious that the above-mentioned conventional artificial leather is useful only for articles of clothing requiring high degrees of softness and flexibility. However, it is desirable to provide a type of artificial leather useful for special types of articles of clothing and shoe leather which requires a relatively high flexural rigidity and a high dimensional stability.

It is known that artificial leather having a high flexural rigidity and a high dimensional stability can be provided by applying a large amount of elastic polymer material to the conventional non-woven fabric so as to fill in the spaces between the individual fibers in the fabric. However, large amounts of elastic polymer material cause an undesirable feel to the touch. That is, this type of artificial leather feels like a rubber sheet, rather than natural leather.

An object of the present invention is to provide a non-woven fabric usable as a substratum sheet for artificial leather having a proper flexural rigidity which feels like natural leather, together with a process for producing the same.

Another object of the present invention is to provide a non-woven fabric usable as a substratum sheet for artificial leather having a high dimensional stability, and configuration and which feels like calf or deer skin, and a process for producing the same.

Still another object of the present invention is to provide a non-woven fabric usable as a substratum sheet for artificial leather, capable of providing a natural suede-like surface on said artificial leather, and a process for producing the same.

The above-mentioned objects can be attained by the non-woven fabric of the present invention which comprises numerous fibrous bundles entangled with each other, said fibrous bundles consisting of a plurality of extremely fine filaments or fibers having a denier of 0.005 to 0.5 and spontaneously adhering to each other without using an adhesive. The above non-woven fabric can be produced by the process of the present invention which comprises providing numerous fibrous bundles each consisting of a plurality of extremely fine filaments or fibers having a denier of 0.005 to 0.5 while allowing said filaments or fibers to spontaneously adhere to each other without using an adhesive, massing said fibrous bundles in the form of a sheet, and subjecting said sheet to an operation in which said fibrous bundles are entangled with each other in order to convert said sheet into a non-woven fabric.

With respect to the fibrous bundle of the present invention, it is important that the individual filaments or fibers in said fibrous bundle are divisible from each other by a mechanical action, for example, rubbing impacting and splitting.

In the non-woven fabric of the present invention, it is possible to vary the adhering strength of the individual filaments or fibers in the filament bundle to each other. Such variation of the adhering strength of the individual filaments or fibers causes variation in the flexural rigidity and softness of the resultant artificial leather. In other words, by controlling the adhering strength, it is possible to control the flexural rigidity, softness and feel of the artificial leather.

The artificial leather containing therein the non-woven fabric of the present invention is stiffer than that containing the conventional non-woven fabric composed of fiber bundles in which the individual filaments or fibers are not adhered to each other. However, the non-woven fabric of the present invention is useful for producing artificial leather, for example, shoe leather and special articles of clothing which require a relatively high flexural rigidity, a high dimensional stability, and a high recovery from deformation.

In the non-woven fabric of the present invention, the fibrous bundle may either be in the form of a continuous filament or of a staple fiber and may consist of any type of filament or fiber. The fibrous bundles may consist of a regenerated cellulose rayon, cellulose diacetate, cellulose triacetate or a synthetic polymer, for example, polyamide, polyacrylonitrile, polyethylene or polypropylene. The regenerated cellulose rayon may be either cuprammonium rayon or viscose rayon. The polyamide may be either nylon 6 or nylon 66. The fibrous bundle is composed of a plurality of extremely fine filaments or fibers having a denier of 0.005 through 0.5, preferably, 0.01 through 0.2, and which spontaneously adhere (bond) to each other without using an adhesive.

If the denier of the individual filaments is smaller than 0.005, its tenacity is too low, with regard to practical use, but if the individual filaments have a denier larger than 0.5, the resultant artificial leather has a poor flexural softness. The denier of the fibrous bundle can be adjusted in response to the type of process for producing fibrous bundles, the type of method for processing said fibrous bundles and the way the fibrous bundle are used. Generally, a fibrous bundle having a denier of 1 through 200 is useful for artificial leather. For example, fibrous bundles to be processed by the carding engine and the needle-punching machine, should preferably have a denier of 1 to 30 which is determined in consideration of the density of the resultant non-woven fabric. Also, it is preferable that fibrous bundles consisting of continuous filaments have a denier of 1 through 30 after the fibrous bundles were entangled with each other, which denier is determined in consideration of the density of the resultant non-woven fabric.

When the fibrous bundle consists of a regenerated cellulose rayon, the spontaneous adhering of the individual filaments is effected by a method whereby a cellulose solution is extruded through a plurality of spinning orifices into a coagulation bath in order to produce a plurality of filaments and while the coagulation is still incomplete, the filaments are brought into direct contact with each other by means of, for example, a bundling guide, and are allowed to spontaneously adhere to each other. After the coagulation is completed, the filament bundle is withdrawn from the coagulating bath and is subjected to a process for converting the filament bundle into a non-woven fabric.

When the fibrous bundle consists of a polyamide material, spontaneous adhering of individual filaments which have been produced by a conventional melt-spinning and drawing process, is effected by bringing the polyamide filaments into direct contact with each other in a superheated steam atmosphere at a temperature of 130 to 200° C. while allowing the filaments to spontaneously adhere to each other.

In the case where the polyamide filaments are produced by the conventional melt-spinning and drawing process, there is a defect in that during the drawing operation, the individual filaments or the filament bundle are broken due to the very small denier of the individual filaments. In order to avoid the breakage of the individual filaments or filament bundle in the drawing operation, an islands-in-a-sea type composite filament can be utilized. The composite filament is composed of a plurality of extremely fine polyamide island constituents and a sea constituent in which said island constituents are embedded. The sea constituent is dissolved in a solvent which is not capable of dissolving the polyamide island constituents, thereby leaving a plurality of extremely fine polyamide filaments.

Said extremely fine polyamide filaments can be spontaneously adhered to each other by the above-mentioned method. Although this method is complicated, the filaments can be protected from breakage during the drawing operation.

The polyamide filaments can also be adhered to each other without using an adhesive, by heating them to a temperature higher than the melting point thereof. However, this method is not preferable because the individual filaments adhere to each other excessively and the resultant bundle can not be divided into small bundles and individual filaments.

Generally, the adhering strength of the filaments can be adjusted to the desired extent by adjusting the location of the bundling guide and bundling load.

For example, when the regenerated cellulose filaments are bundled at an earlier stage of the coagulation, the filaments are relatively firmly adhered to each other. In the case where the bundling operation of the regenerated cellulose filaments is effected at a latter stage of the coagulation, the adhering of the filaments to each other is relatively loose.

The adhering strength of the polyamide filaments can be controlled by varying the temperature of the superheated steam atmosphere, the bundling load, the bundling time, and the travelling velocity of the filament in the steam atmosphere.

In the fibrous bundle of the present invention, the individual filaments are adhered to each other side by side.

The filament bundles of the present invention may be used in the form of a continuous filament or in the staple fiber form. The filament bundles may be crimped before the massing operation.

When the filament bundles are in the form of staple fibers, they can be massed by means of a carding engine, a cross layer and/or a random webber, into the form of a web.

When the filament bundles are in the form of continuous filaments, they can be massed into a flat sheet form by being randomly on a wire net. This accumulating operation may be effected by ejecting the filament bundles together with a jet of a fluid, for example, water or air, onto the wire net. Also, a flat sheet of continuous filament bundles can be produced by providing a plurality of filament bundle layers in each of which numerous filament bundles are arranged side by side, and then superimposing a plurality of the filament bundle layers on each other. This superimposing operation may be carried out by folding the filament bundle layer once or more. Otherwise, the superimposing operation may be carried out in such a manner that the filament bundles in a layer run at an angle to the filament bundles in adjacent layers. In this case, the filament bundles may run at an inclined angle to the longitudinal axis of the sheet.

Further, the massing operation of the continuous filament bundles may be carried out in such a manner that a first group of filament bundles is arranged side by side and a second group of filament bundles is also arranged side by side but at an angle of 30° through 120° to the filament bundles in the first group. In this case, every filament bundle runs at an inclined angle to the longitudinal axis of the sheet.

In order to convert the web or sheet prepared by any one of the above-mentioned methods to a non-woven fabric, it is subjected to a needle-punching operation, whereby the fibrous bundles are entangled and intertwined with each other.

According to another method, the web or sheet is subjected to an operation in which numerous jets of a fluid, for example, air or water, are directed onto the web or sheet. By the action of said jets of fluid, the fibrous bundles are mutually entangled and intertwined.

Figure 2A:
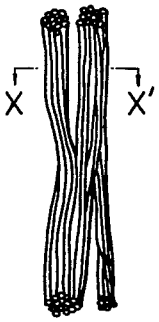
Figure 3A:
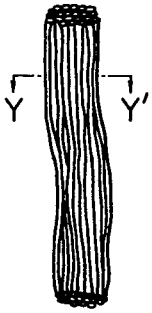
Figure 4:
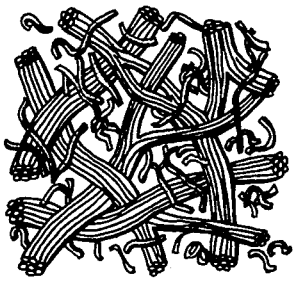
Figure 2B:
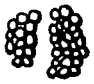
Figure 3B:
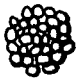
Figure 5:
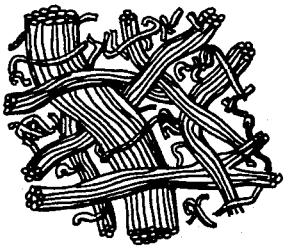
Figure 6:
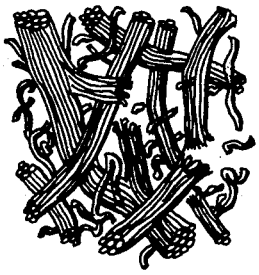
Figure 7:
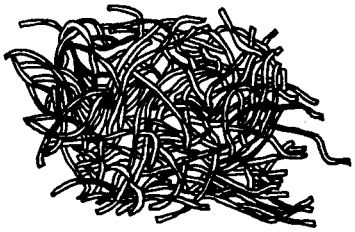
Figure 8:
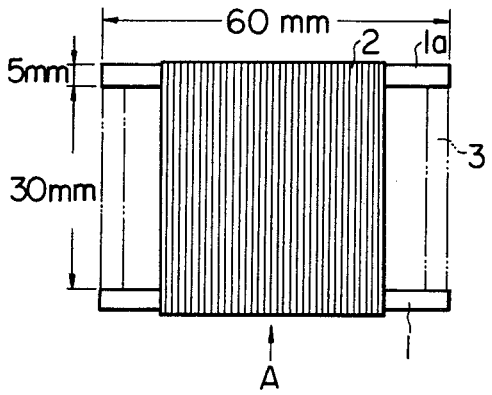
Figure 9:
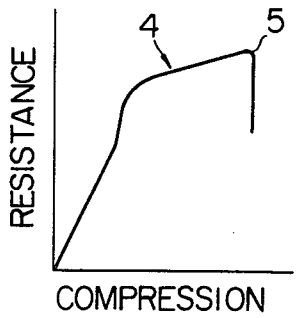
Figure 10:
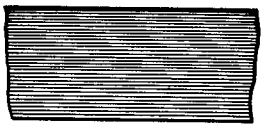
Figure 11:
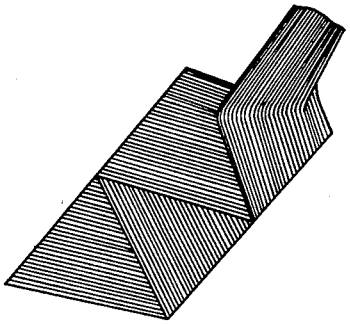
Figure 16:
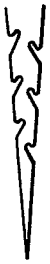
Figure 17:
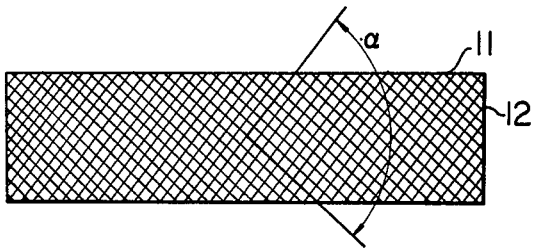
Figure 18:
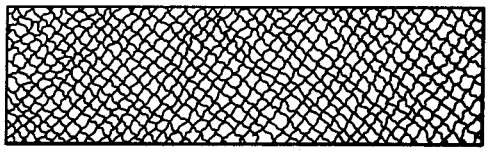
Figure 19:
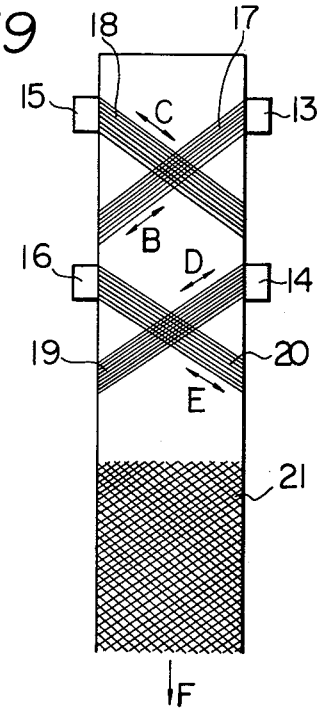

Further features and advantages of the present invention will be apparent from the following description, reference being made to the accompanying drawings, wherein FIG. 1 is an explanatory view of an internal structure of the non-woven fabric of the present invention, which fabric is composed of fibrous bundles entangled with each other, FIGS. 2A and 3A are respectively explanatory side views of an embodiment of the fibrous bundle of the present invention, FIGS. 2B and 3B are explanatory cross-sectional views of the fibrous bundles of FIG. 2A and FIG. 3A along the lines X-X' and Y-Y', respectively, FIGS. 4 through 6 are respectively explanatory views of an internal structure of an embodiment of the non-woven fabric of the present invention, FIG. 7 is an explanatory view of an internal structure of a conventional non-woven fabric composed of individual fibers, FIG. 8 is an explanatory view of a device for determining the flexural rigidity of the fibrous bundle, FIG. 9 is a diagram indicating a relationship between compression and resistance of the fibrous bundle against the compression in the test for determining the flexural rigidity of the fibrous bundle, FIG. 10 is an explanatory view of a para lay sheet in which the filaments run side by side, FIG. 11 is an explanatory view of a method for preparing a cross lay sheet from the para lay sheet of FIG. 10, FIGS. 12A through 12D are respectively explanatory views of a small fibrous bundle divided from the filament bundle of FIG. 3A, FIGS. 13 through 16 are respectively explanatory side views of a needle for the needle punching operation, FIGS. 17 and 18 are respectively explanatory views of a sheet composed of numerous filament bundles intersecting each other, and FIG. 19 is an explanatory view of a device for preparing the sheets of FIGS. 17 and 18.

The internal structure of the non-woven fabric of the present invention can be observed in detail by means of a scanning electron microscope. As a result of observation, it was found that the fibrous bundles in the non-woven fabric are sometimes divided into small bundles and individual filaments during the needle punching operation or during the fluid jetting operation.

Referring to FIG. 1, the numerous fibrous bundles are entangled with each other. However, they are divided into neither small bundles nor individual filaments, nor are they broken. That is, all of the fibrous bundles in FIG. 1 are maintained in their original configuration even after the non-woven fabric forming operation, due to the high adhering strength between the individual filaments.

The fibrous bundle of the present invention may be a branched bundle as indicated in FIGS. 2A and 2B.

Referring to FIGS. 2A and 2B, the fibrous bundle is divided, at its upper and lower end portions, into two branch bundles. In other words, at the middle portion of the bundle, two branch bundles are incorporated together, with to form a body.

Referring to FIGS. 3A and 3B, all of the individual filaments continuously adhere to each other so as to form a compact bundle. In the cases of both FIGS. 2A and 2B and FIGS. 3A and 3B, the individual filaments are restricted in their freedom of relative movement to each other.

Referring to FIG. 4, the fibrous bundles are partially divided into small branch bundles and individual filaments, but are not broken. Accordingly, the non-woven fabric of FIG. 4 is composed of fibrous bundles, small branch fibrous bundles and individual filaments, all of which are entangled with each other.

Referring to FIG. 5, the division of the fibrous bundles is larger than that of FIG. 4. That is, some of the fibrous bundles are completely divided into small bundles and individual filaments.

Referring to FIG. 6, the fibrous bundles are divided into small bundles and individual filaments and the small bundles are then broken.

In FIGS. 4 through 6, although the individual filaments in the fibrous bundles and small bundles are restricted in their relative movement to each other, the individual filaments separated from the bundles can freely move and fill the spaces formed between the bundles.

If a non-woven fabric is produced from fibrous bundles in which the individual filaments are not adhered to each other, the bundles are completely divided into individual filaments by the action of needle-punching or jets of fluid. The resultant non-woven fabric has the internal structure indicated in FIG. 7. Such a type of non-woven fabric has disadvantages in that it is not highly elastic nor is bulky. Therefore, it is unsuitable as a substratum sheet for artificial leather.

As is stated above, in the non-woven fabric of the present invention, a portion of the fibrous bundles may be divided into small fibrous bundles and individual filaments or fibers which are entangled with each other, as well as with the remaining fibrous bundles.

In this case, it is preferable that in said non-woven fabric, the sum weight of the individual filaments or fibers and the small fibrous bundles, each composed of 5 individual filaments or fibers or less, is in an amount of 5 to 95%, more preferably, 15 to 95% by weight.

The amount of individual filaments or fibers and the small fibrous bundles present in the non-woven fabric is determined by the following method.

A specimen of the non-woven fabric having an area of 1 $cm^2$ is first weighed. Said specimen is put on a watch glass and divided into individual filaments or fibers and fibrous bundles with a pincette while observing them through a magnifying glass. Thereafter, the individual filaments or fibers and the small fibrous bundles, each composed of 5 individual filaments or fibers or less, are separated from the remaining bundles, while observing them through a microscope at a magnification of 400. The separated small bundles and filaments are then weighed. The above measurement is repeated 5 times. The proportion in % of the individual filaments or fibers and the small bundles is indicated by a mean value of the results of the 5 measurements.

When the non-woven fabric is produced from cuprammonium rayon fibrous bundles, it is preferable that the fibrous bundle has a flexural rigidity of 15 through 500 mg/100 denier determined by a press-bending test. The press bending test is carried out by the following method.

Referring to FIG. 8, a frame is prepared from a pair of paper bars 1*a* and 1*b* and a pair of metal bars 3. Said paper bars 1*a* and 1*b* have a length of 60 mm and a width of 5 mm and the metal bar 3 has a length of 30 mm. A fibrous bundle 2 is wound onto the frame in the manner indicated in FIG. 8. The resultant sheet on the frame has a total denier of 26,000. After the winding operation is finished, the metal bars 3 are removed. The paper bar 1*a* is fixed and the sheet is compressed in the direction A so as to cause the fibrous bundle sheet to press-bend. FIG. 9 shows the relationship between the compression of the sheet and the resistance of the sheet to said press-bending. Referring to FIG. 9, the resitance of the sheet increases depending on the increase of compression along a curve 4. When the resistance reaches a peak point 5, it rapidly drops. The flexural rigidity of the fibrous bundle is represented by the resistance at said peak point 5 in terms of mg/100 denier. It is obvious that the larger the flexural rigidity, the larger the adhering strength of the individual filaments in the fibrous bundle to each other.

If the curpammonium rayon fibrous bundle has a flexural rigidity smaller than 15 mg/100 denier, the resultant artificial leather is too soft and is poor in bulkiness.

However, if the suprammonium rayon fibrous bundle has a flexural rigidity larger than 500 mg/100 denier, it is difficult to divide the bundle into thin bundles and individual filaments or fibers by a mechanical action, for example, crumbling, rubbing, needle-punching or using a high pressure jet of fluid, in order to reduce the flexural rigidity of the resultant non-woven fabric.

When the fibrous bundle consists of a material other than the cuprammonium rayon, its flexural rigidity is preferably in a range satisfying the following formula:

$$Y/100 \times 15 \leqq x \leqq Y/100 \times 500$$

wherein $x$ represents the flexural rigidity in mg/100 denier of the fibrous bundle to be tested and Y represents an Young's modulus of the filament in the fibrous bundle to be tested. The cuprammonium rayon filaments have a Young's modulus ranging from about 80 to about 120 g/d. Accordingly, the average Young's modulus of the curpammonium rayon is about 100 g/d. The term Y/100 represents a ratio of Young's modulus of the filaments to be tested to the average Young's modulus of the cuprammonium rayon filaments.

The continuous filaments bundles can be formed into the para lay sheet indicated in FIG. 10 by arranging them side by side. Said para lay sheet can be further formed into a cross lay sheet by folding said para lay sheet in the manner indicated in FIG. 11.

In the non-woven fabric of the present invention, the continuous filament bundles may be arranged in the manner indicated in FIGS. 17 and 18. Referring to FIG. 17, a sheet 11 is composed of continuous filament bundles 12 intersecting each other at an angle of $\alpha$. In the sheet 11, the bundles 12 run at an inclined angle to the longitudinal axis of said sheet 11. The intersecting angle is preferably in range from 30° to 120°, in order to obtain a suede-like artificial leather by way of buffing. The filament bundles may be straight as indicated in FIG. 17 or crimped as indicated in FIG. 18.

The sheet structure indicated in either FIG. 17 or 18 can be prepared by using the device of FIG. 19. Referring to FIG. 19, filament bundles 17 and 19 are fed through feed entrances 13 and 14 and reciprocally run in the directions B and D, respectively. Other filament bundles 18 and 19 are fed through feed entrances 15 and 16 and are reciprocally run in the directions C and E. The directions B, C, D, E respectively have an inclined angle to the direction F, in which the resultant sheet 21 is moved.

Figure 13:
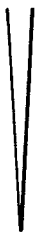

The web or sheet composed of the fibrous bundles of the present invention is converted into a nonwoven fabric by needle-punching said web or sheet or by directing numerous jets of a fluid, for example, air or water, onto the web or sheet under a high pressure. For the needle-punching operation, the needle may be, for example, in any of the configurations indicated in FIGS. 13 through 16. The needle of FIG. 13 is straight and has no barb. The needle of FIG. 14 has a plurality of cavities. The needle of FIG. 15 has a plurality of protruberances. The needle of FIG. 16 has a plurality of barbs.

Figure 12A:
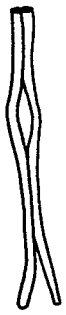
Figure 12B:
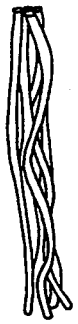
Figure 12C:
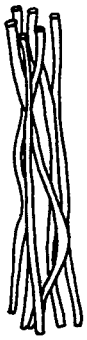
Figure 12D:
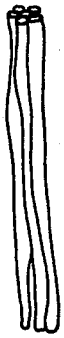

By the action of the needle or said jet of fluid, the fibrous bundle is divided into small bundles, as indicated in FIGS. 12A through 12D for example. The bundle of FIG. 12A is composed of two individual fibers which are adhered to each other at certain portions thereof but which are separated from the other at the remaining portions thereof. In the bundle of FIG. 12B several individual fibers are adhered to each other at some portions thereof but are separated from each other at other portions thereof. In the bundle of FIG. 12C, the individual fibers are randomly adhered to the adjacent fibers and are divided from the adjacent fibers at random. In addition, some of the individual fibers are entangled with adjacent fibers at random. FIG. 12D shows a compact bundle composed of fine individual fibers firmly adhered to adjacent fibers.

In order to convert the fibrous bundle web or sheet into non-woven fabric by directing jets of water thereonto, it is preferable that said jets of water are directed through nozzles having a diameter of 0.05 mm or larger, under a pressure of 10 to 300 kg/cm$^2$. When said jets of water are directed under a pressure of 70 kg/cm$^2$ or higher, some of the fibrous bundles in the web or sheet may be divided into small bundles and individual filaments or fibers while some of the small bundles and the individual filaments or fibers may be broken.

The non-woven fabric of the present invention, prepared by any one of the above-mentioned methods, has a high bulkiness due to the high flexural rigidity of the fibrous bundles and a proper softness and flexibility due to the divisible property of the fibrous bundles.

The non-woven fabric of the present invention can be converted into an artificial leather by impregnating the fabric with an elastic synthetic polymer, for example, polyurethane, synthetic rubber such as MBR and SBR; elastic polyvinyl chloride; elastic acrylic polymers; polyaminoacid; or elastic copolymers of two or more monomers for the above-mentioned polymers. The resultant leather-like sheet may be divided into two or more pieces having a desired thickness by slicing the sheet with a slicer along the surface of said sheet. The surface of the leather-like sheet may be raised by way of buffing. In this case, the resultant leather-like sheet has a suede-like or velour-like surface on which the individual fibers are uniformly raised. The buffing operation may be applied onto the non-woven fabric before the impregnating operation is applied to the fabric.

Otherwise, the surface of the leather-like sheet may be coated with a thin layer of a polyurethane. In this case, a grain side layer is formed on the leather-like sheet surface.

The features and advantages of the present invention are further illustrated by the examples set forth hereinafter, which are not intended to limit the scope of the present invention, in any way.

EXAMPLE 1

A cellulose solution was prepared by a cuprammonium process and extruded through a spinneret having 50 spinning orifices, into a coagulating water bath so as to form 50 filamentary solution streams. When the filamentary solution streams were incompletely coagulated in the water bath, the resultant filaments were bundled by means of a bundling guide so as to allow the bundled filaments to spontaneously adhere to each other without adhesive. Thereafter, the filament bundle was completely coagulated in the water bath and was then withdrawn. The withdrawn filament bundle was wound up on a bobbin at a wind-up velocity of 30 m/min. The resultant filament bundle had a denier of 5.0 and was composed of 50 cuprammonium rayon filaments, each having a denier of 0.1.

The filament bundle was subjected to a press-bending test. As a result, it was determined that the filament bundle had a flexural rigidity of 280 mg/100 denier.

The filament bundle was sized with an aqueous solution of polyvinyl alcohol and dried so that the filament bundle was impregnated with 3% of dry polyvinyl alcohol, based on the weight of the filament bundle. A tow was prepared by bundling 200 filament bundles produced by the same method as mentioned above, and was crimped by means of a stuffing box. The tow thus crimped was cut to provide cuprammonium staple fibers, each being composed of a fibrous bundle having a length of 51 mm.

The cuprammonium staple fibers were opened by means of an opener carding engine so as to form a plurality of webs in which the fibrous bundles were located at random. The webs were converted to a nonwoven fabric having a weight of 1200 g/m$^2$ by means of a cross layer and a needle punching machine. The non-woven fabric was observed by a scanning electron microscope at a magnification of 1000. It was confirmed that in the non-woven fabric, numerous fibrous bundles were intertwined or entangled with each other, in the condition shown in FIG. 1 of the accompanying drawings.

The non-woven fabric thus produced was immersed in an aqueous solution of 5% by weight of polyvinyl alcohol, squeezed with a mangle so that the non-woven fabric was impregnated with 150% of the polyvinyl alcohol solution based on the weight of the non-woven fabric and was then dried at a temperature of 100° C. Thereafter, the non-woven fabric was immersed in a solution of 2% by weight of polyurethane in dimethyl formamide, squeezed with a mangle so that the non-woven fabric was impregnated with 400% of the polyurethane solution based on the weight of the non-woven fabric, and, then, immersed in a mixture solution of 50 parts by weight of water and 50 parts by weight of dimethyl formamide in order to incompletely coagulate the polyurethane. The non-woven fabric was further squeezed with a mangle and was immersed in a water bath so as to completely coagulate the polyurethane.

Before drying, the above treated non-woven fabric was sliced along the surface thereof with a slicer so that after drying, the sliced non-woven fabric had a thickness of 1.5 mm.

The sliced non-woven fabric had a leather-like configuration and a weight of 280 g/m$^2$.

The leather-like sheet prepared above was treated in a boiling water bath for 10 minutes to eliminate the polyvinyl alcohol therefrom. The resultant leather-like sheet had a proper flexibility and a relatively high stiffness. That is, the flexural rigidity (flex stiffness) of the leather-like sheet was approximately the same as that of natural cowhide used as shoe leather.

After standing in an atmosphere having a temperature of 20° C and a relative humidity of 60% for 24 hours, the leather-like sheet obtained a relative large moisture content of 3.6 mg/cm$^2$.

For comparison, a commercial artificial leather comprising a non-woven fabric consisting of nylon 6 fibers as a substratum sheet, was left standing in the same method as mentioned above. The commercial artificial leather obtained had a small moisture content of 0.6 mg/cm$^2$.

In order to provide an artificial leather having a grain side layer, a solution of 25% by weight of polyurethane in dimethyl formamide was applied by a knife coater onto a surface of the leather-like sheet. Said leather-like sheet thus coated was then immersed in a water bath in order to coagulate the polyurethane from the solution.

The resultant artificial leather having a grain side layer consisting of the polyurethane was usable as shoe leather and had the following properties.

| | |
|---|---|
| Proportion in weight of polyurethane to non-woven fabric | 60/40 |
| Weight | 650 g/m$^2$ |
| Thickness | 1.5 mm |
| Tensile strength | 0.54 kg/mm$^2$ |
| Breaking elongation | 45% |
| Softness | 15mm |

Note: The softness was measured by way of the Cantilever test provided in ASTM D-1388-64.

EXAMPLE 2

A cellulose solution prepared by a cuprammonium process was extruded through a spinneret having 50 spinning orifices, into a coagulating water bath. 50 cuprammonium rayon filaments each having a denier of 0.07 were obtained in the water bath. The filaments were withdrawn from the water bath and dried in a dryer under a tension of 1 g/denier at a temperature of 95° C so that the filaments spontaneously adhered to each other without adhesive to form a filament bundle. The bundle thus obtained had a denier of 3.5 and was composed of 50 filaments adhered to each other without an adhesive, each filament having a denier of 0.07. By the press-bending test, it was determined that the filament bundle had a flexural rigidity (flex stiffness) of 20 mg/100 denier, which allows the individual filaments in the bundle to be released from said adhesion by hand-rubbing the bundle.

The filament bundles thus produced were immersed in a solution of 10% by weight of a copolymer CM-4000, which is a trade mark of a nylon 6-nylon 66 - nylon 612 copolymer made by Toray Industries Inc., in methyl alcohol, and were then squeezed and dried so that said filament bundles were impregnated with 0.5% of the copolymer based on the weight of the filament bundles. The filament bundles thus sized were crimped by means of a stuffing box, with a crimp number of 12 crimps/inch. The crimped filament bundles were cut into pieces 5.1 cm long. in order to provide staple fibers, each consisting of a fibrous bundle.

The staple fibers were converted into a non-woven fabric having a weight of 600 g/m$^2$ by means of a carding engine, a cross-layer and a needle-punching machine. The non-woven fabric was immersed in a solution of 10% by weight of a polyurethane in dimethyl formamide, squeezed by a mangle so that the non-woven fabric was impregnated with 400% of the polyurethane solution based on the weight of the non-woven fabric, and was then immersed in a water bath in order to coagulate the polyurethane from the solution, and was dried at a temperature of 70° C. The thus dried non-woven fabric was sliced by a slicer to form three sheets, each having a weight of approximately 200 g/m. The sheets were immersed methyl alcohol to remove the copolymer therefrom.

The sheets thus treated were thinly coated with a solution of 25% by weight of polyurethane in dimethylformamide, were immersed in a water bath to coagulate the polyurethane from the solution, and were then dried. The dried sheets were buffed resulting in three leather-like sheets having a suede-like surface.

The above leather-like sheets had the following properties.

| | |
|---|---|
| Proportion by weight of polyurethane to non-woven fabric | 25/75 |
| Weight | 198 g/m$^2$ |
| Thickness | 0.8 mm |
| Tensile strength | 0.65 kg/mm$^2$ |
| Breaking elongation | 31% |
| Softness (cantilever test) | 65 mm |

The softness of the leather-like sheets was approximately the same as that of calf skin or deer skin.

EXAMPLE 3

A cellulose solution was prepared by a cuprammonium process and extruded through a spinneret having 200 spinning orifices into a coagulating water bath to form 200 cuprammonium rayon filaments, each having a denier of 0.1. While the filaments were incompletely coagulated, they were divided into four groups, each consisting of 50 filaments and each group of the filaments was bundled by means of a bundling guide. The bundled filaments were completely coagulated, discharged from the water bath and were then dropped onto a wire net having a width of 20 cm, which resulted in the filament bundles becoming intertwined and entangled with each other so as to form a non-woven fabric. The filaments in the bundles were maintained in such a state that they adhered to each other without adhesive. The resultant non-woven fabric had an internal structure similar to that indicated in FIG. 1 of the accompanying drawings.

A filament bundle was removed from the non-woven fabric and subjected to the press-bending test. It was determined that said filament bundle had a flexural rigidity (flex stiffness) of 50 mg/100 denier.

The non-woven fabric was washed with water, dried at a temperature of 70° C, and was then compressed by a pair of pressing rollers at a temperature of 170° C under a pressure of 10 kg/cm$^2$. The non-woven fabric thus compressed had a weight of 400 g/m$^2$. Said fabric was immersed in a solution of 15% by weight of polyurethane in dimethylformamide, squeezed with a mangle so that it was impregnated with 400% of the solution based on the weight of the fabric, immersed in water so as to coagulate the polyurethane from the solution and then dried. The dried non-woven fabric was then sliced by a slicer along the surface thereof into two pieces and buffed on the sliced surfaces thereof. Two pieces of suede-like sheets were obtained. The suede-like sheets were slightly softer to the touch than the suede-like sheets obtained in Example 2. The sheets had the following properties.

| | |
|---|---|
| Proportion by weight of polyurethane to non-woven fabric | 25/75 |
| Weight | 250 g/m$^2$ |
| Thickness | 1.0 mm |
| Tensile strength | 0.66 kg/mm$^2$ |
| Breaking elongation | 28% |
| Softness (Cantilever test) | 60 mm |

The suede-like sheets were washed with a soap solution by hand-rubbing. Said washing operation was repeated 20 times. The softness of the suede-like sheets increased in proportion to the number of times they were washed. After being washed 20 times, the suede-like sheets were softer than those of Example 2, and had a softness of 67 mm (Cantilever test).

EXAMPLE 4

A cellulose solution prepared by a cuprammonium process was extruded through a spinneret having 50 spinning orifices and was coagulated in a water bath so as to form 50 cuprammonium rayon filaments, each having a denier of 0.07. While the filaments were in an incompletely coagulated state, they were bundled by means of a bundling guide so as to allow said filaments to adhere to each other without adhesive. After the completion of coagulation, the filament bundle was discharged from the water bath and dried. A filament bundle having a denier of 3.5 was obtained. As a result of the press-bending test, it was determined that the filament bundle had a flexural rigidity (flex stiffness) of 150 mg/100 denier.

The filament bundle thus produced was immersed in a solution of 10% by weight of a polyvinyl alcohol having a molecular weight of 3000, in water squeezed with a mangle so that the filament bundle was impregnated with 0.5% of the solid copolymer based on the weight of the filament bundle, and then dried. Thereafter, the filament bundle sized above was crimped by means of a stuffing box with a crimp number of 12 crimps/inch, and was then cut into pieces 5 cm long to provide staple fibers, each consisting of a fibrous bundle. Said staple fibers were converted into a non-woven fabric having a weight of 150 g/m, and a thickness of 0.9 mm by means of a carding engine, a crosslayer and a needle-punching machine.

The non-woven fabric was divided into three pieces and each piece was impregnated with a solution of 20% by weight of a polyurethane in dimethylformamide to the extent shown in Table 1. The polyurethane was then coagulated in water.

The pieces of the non-woven fabric thus impregnated with the polyurethane were immersed in a boiling water bath to remove the polyvinyl alcohol therefrom, and were dried to form leather-like sheets.

The surface of each piece of the leather-like sheet was buffed to form a suede-like surface.

The resultant pieces of suede-like sheets had the properties indicated in Table 1.

Table 1

| Piece No. | Proportion by weight of polyurethane to non-woven fabric | Weight ($g/m^2$) | Thickness (mm) | Tensile strength ($kg/mm^2$) | Breaking elongation (%) | Softness (Cantilever test (mm) |
|---|---|---|---|---|---|---|
| (1) | 10/90 | 165 | 0.8 | 0.54 | 25 | 85 |
| (2) | 30/70 | 195 | 0.8 | 0.58 | 30 | 70 |
| (3) | 50/50 | 300 | 0.9 | 0.62 | 35 | 65 |

In Table 1, piece (1) felt like natural leather with the proper softness. Piece (2) felt like natural leather, and was slightly softer than piece (1). Piece (3) was relatively stiff and felt like a rubber sheet.

EXAMPLE 5

A cellulose solution prepared by a cuprammonium process was extruded through a spinneret having 50 spinning orifices, into a water bath to form 50 filaments, each having a denier of 0.1. While the extruded filaments were incompletely coagulated in the water bath, the filaments were bundled by a bundling guide so as to allow said filaments to spontaneously adhere to each other without adhesive. A filament bundle having a denier of 5 was obtained. The same operations as mentioned above were carried out three more times by changing the location of the bundling guide in the water bath. Four types of filament bundles were obtained, which respectively had flexural rigidities (flex stiffness) of 15, 50, 100 and 250 mg/100 denier. For each type of filament bundle, a tow was prepared from 10,000 filament bundles.

The tows were immersed in a solution of 3% by weight of methylmethoxy nylon 66 in methyl alcohol, squeezed and dried so as to impregnate the tows with 10% of the methyl methoxy nylon. The tows were crimped by a stuffing box and cut into pieces 5 cm long so as to prepare staple fibers. Each type staple fiber was converted to a non-woven fabric by means of a carding engine, a cross-layer and a needle-punching machine. The needle punching operation was carried out with a needling number of 100 times/$in^2$. The non-woven fabrics were immersed in an aqueous solution of 3% of polyvinyl alcohol, squeezed with a mangle and dried. The dried non-woven fabrics were adjusted to a thickness of 0.9 mm by slicing them along the surface thereof with a slicer.

The non-woven fabrics thus sliced were immersed in methyl alcohol at a temperature of 50° C to remove the methylmethoxy nylon from the fabrics. Thereafter, the non-woven fabrics were immersed in a solution of 10% by weight of a polyurethane in dimethylformamide and were then immersed in water to coagulate the polyurethane so as to prepare leather-like sheets. The leather-like sheets thus prepared were immersed in a boiling water bath to remove the polyvinyl alcohol therefrom. The resultant leather-like sheets were buffed on the surfaces thereof. Four types of suede-like sheets were obtained.

For comparison, procedures identical to those mentioned above were repeated except that the filaments in the incompletely coagulated state were not bundled in the water bath and therefore did not adhered to each other. In order to form a filament bundle, the five filaments, each having a denier of 0.1, were caused to adhere to each other by immersing then in a solution of 3% by weight of methyl methoxy nylon in methyl alcohol. Said filaments were then dried. During the bundle-forming operation period, many problems occurred. That is, numerous fine filaments were broken, many fluffs were formed on the bundle surface and the bundle was deformed. From the comparison filament bundles, several samples having a relatively good quality were chosen. A leather-like sheet was prepared from the chosen samples of the comparison filament bundles by the same method as mentioned above. After the methylmethoxy nylon was removed, the filaments in the bundle were separated from each other.

The above-obtained leather-like sheets and the comparison sheets had the properties shown in Table 2. The comparison sheets had a low resiliency and a low bulkiness.

Table 2

| Piece No. | Flexural rigidity mg/100 denier | Thickness (mm) | Weight ($g/m^2$) | Proportion by weight of polyurethane to non-woven fabric | Tensile strength ($kg/mm^2$) | Breaking elongation (%) | Softness (Cantilever test) (mm) |
|---|---|---|---|---|---|---|---|
| Compari- | none | 1.0 | 250 | 30/70 | 0.63 | 35 | 87 |
| (1) | 15 | 1.0 | 250 | 30/70 | 0.62 | 32 | 68 |
| (2) | 50 | 1.0 | 250 | 30/70 | 0.62 | 30 | 50 |
| (3) | 100 | 1.0 | 250 | 30/70 | 0.61 | 30 | 41 |
| (4) | 250 | 1.0 | 250 | 30/70 | 0.61 | 28 | 35 |

EXAMPLE 6

A solution of sodium cellulose xanthate (viscose) was extruded through a spinneret having 300 spinning orifices into a coagulating bath consisting of a diluted sulfuric acid aqueous solution to produce viscose rayon filaments, each having a denier of 0.1. While the viscose rayon filaments were incompletely coagulated in the coagulating bath, the filaments were bundled by a bundling guide so that said filaments spontaneously adhered to each other without adhesive. Thereafter, the filament bundle was completely coagulated and wound up on a hank spool. The resultant bundle had a denier of 30 and was composed of 300 viscose rayon filaments each adhering to the others each having a denier of 0.1. The filament bundle had a flexural rigidity (flex stiffness) of 200 mg/100 denier which was determined by the press-bending test.

The viscose rayon filament bundle was sized with 3% of polyvinyl alcohol based on the weight of the filament bundle. A tow was prepared by bundling 400 threads of the sized filament bundles. Said tow was crimped by means of a stuffing box and cut into pieces 50 mm long in order to produce staple fibers each consisting a fibrous bundle. The staple fibers were opened by means of a carding engine so that the fibrous bundles were separated from each other and were distributed at random. The opened staple fibers were converted into a non-woven fabric having a weight of 450 g/m$^2$ by means of a cross-layer and a needle-punching machine. The non-woven fabric was observed by a scattering electron microscope. As a result, the internal structure of the fabric looked as indicated in FIG. 1 of the accompanying drawings. That is, the non-woven fabric was composed of fibrous bundles wherein viscose rayon fine fibers adhered to each other without adhesive. The non-woven fabric was immersed into an aqueous solution of 10% by weight of polyvinyl alcohol, was squeezed by a mangle and was dried at a temperature of 100° C so that the non-woven fabric was impregnated with 3% of said dry polyvinyl alcohol based on the weight of the fabric. Then, the non-woven fabric was immersed in a solution of 20% by weight of a polyurethane in dimethylformamide, was squeezed with a mangle, and was immersed in a mixture solution of 50 parts by weight of water and 50 parts by weight of dimethylformamide, in order to incompletely coagulate the polyurethane. The non-woven fabric treated above was squeezed with a mangle and further immersed in water so as to completely coagulate said polyurethane. After the drying operation, a rough surfaced layer of the non-woven fabric was removed by a slicer to form a non-woven fabric having a smooth surface. The smooth surfaced fabric was immersed in a boiling water bath to eliminate the polyvinyl alcohol from the fabric. A leather-like sheet which was flexible but considerably stiff, was obtained. The stiffness of the resultant leather-like sheet is approximately similar to that of cowhide usable as shoe leather.

Further, a solution of 25% of polyurethane in dimethylformamide was applied by a reversing coater onto a surface of the leather-like sheet and coagulated in water to form a grain side layer.

The resultant artificial leather having a grain side layer had the following properties.

| | |
|---|---|
| Proportion by weight of polyurethane to non-woven fabric | 60/40 |
| Weight | 700 g/m$^2$ |
| Thickness | 1.7 mm |
| Tensile strength | 0.50 kg/mm$^2$ |
| Breaking elongation | 70% |
| Softness (Cantilever test) | 12 mm |

Comparison Example 1

The same procedures as those in Example 4 were repeated, except that the filaments were not bundled by the bundling guide and did not spontaneously adhere to each other. A cuprammonium rayon filament bundle thus prepared had a denier of 3.5, and composed of 50 filaments, each having a denier of 0.07, which filaments were kept separate from each other. The resultant filament bundle was not wound up but was directly impregnated with a solution of the same copolymer as that used in Example 4 so that 0.5% of the polyvinyl alcohol based on the weight of the filament bundle, was deposited on the bundle surface.

The filament bundle was crimped by a stuffing box with a crimp number of 12 crimps/inch and was cut into pieces 5 cm long in order to form staple fibers. Said staple fibers were converted into a comparison non-woven fabric having a weight of 150 g/m$^2$ by means a cardong engine, a cross layer and needle-punching machine.

It was observed by way of a scattering electron microscope that the comparison non-woven fabric had the internal structure indicated in FIG. 7 of the accompanying drawings. That is, the non-woven fabric was composed of fine individual fibers released from the fiber bundle, and entangled and intertwined with each other. No fibrous bundle was observed. The comparison non-woven fabric had a very lower bulkiness than that of the non-woven fabric of Example 4. That is, by the method of Example 4, the random web having a weight of 170 g/m$^2$ could be converted into a non-woven fabric having a weight of 150 g/m$^2$ and a thickness of 0.9 mm, while by the method of the present comparison example, the random web of a weight of 170 g/m$^2$ could be converted to a thin non-woven fabric having a weight of 145 g/m$^2$ and a thickness of 0.5 mm. The comparison nonwoven fabric was divided into three pieces and treated by the same procedures as in Example 4 so as to prepare three pices leather-like sheets as indicated in Table 3, for the purpose of comparison.

Table 3

| Comparison piece No. | Proportion by weight of polyurethane to non-woven fabric | Weight (g/m$^2$) | Thickness (mm) | Tensile strength (kg/mm$^2$) | Breaking elongation (%) | Softness (Cantilever test) (mm) |
|---|---|---|---|---|---|---|
| (1) | 10/90 | 165 | 0.5 | 0.55 | 20 | 96 |
| (2) | 30/70 | 195 | 0.5 | 0.60 | 32 | 90 |
| (3) | 50/50 | 300 | 0.6 | 0.61 | 38 | 82 |

Comparison piece (1) of the resultant leather-like sheet had a high softness and a low resiliency and felt like fabric. Comparison piece (2) had a desirable softness and felt slightly like a rubber sheet to the touch. Comparison piece (3) felt like a rubber sheet to the touch and was less soft than that of said comparison piece (2). That is, the comparison leather-like sheet felt more like fabric when the amount of the polyurethane was decreased, and felt more like a rubber sheet when the amount of the polyurethane was increased.

The comparison leather-like sheets prepared above was slightly softer than those in Example 4. However, the feel of the comparison leather-like sheets was similar to that of fabric or a rubber sheet and quite far from that of natural leather.

The difference in the feel between the leather-like sheets of Example 4 and the comparison leather-like sheets of Comparison Example 1 is derived from the fact that in the former sheets, the fine fibers adhered to each other to form a fiber bundle, whereas in the leather sheets, the fine fibers were separated from each other.

EXAMPLE 7

A viscose solution was extruded through a spinneret having 100 spinning orifices into a coagulating bath containing a diluted sulfuric acid aqueous solution so as to produce viscose rayon filaments, each having a denier of 0.1. While the filaments were in an imcompletely coagulated condition, they were bundled by a building guide so that they spontaneously adhered to each other without an adhesive. The resultant bundle had a denier of 10 and was composed of 100 threads of fine viscose rayon filaments, each having a denier of 0.1. The filament bundle had a flexural rigidity of 60 mg/100 devier determines by the press-bending test. In order to form a sheet, the filament bundle was taken up from the coagulating bath, without being wound onto a bobbin, and directly dropped together with water onto an endless rotary wire net. The sheet was immersed in an aqueous solution of 3% by weight of a polyvinyl alcohol, was squeezed with a mangle and was dried so that the sheet was impregnated with 0.5% of the dry polyvinyl alchol based on the weight of the sheet. Said sheet was converted into a non-woven fabric by a needle-punching operation at a density of 3,000 needlings/in$^2$. In this example, the purpose of the needle-punching operation was to entangle and intertwine the filament bundles with each other and to increase the density of the non-woven fabric. Compared with this conventional non-woven fabrics are produced from staple fibers, prepared by cutting continuous filaments. In this case, the purpose of the needle-punching operation is to make the buffing operation of the convention non-woven fabrics, easier.

The non-woven sheet was increased again in an aqueous solution of 3% by weight of a polyvinyl alcohol, brushed onto the surface thereof so as to direct the filament bundles broken by the needle-punching operation in a predetermined direction. A portion of the polyvinyl alcohol solution was removed from the immersed sheet by lightly squeezing the sheet with a pair nipping rollers. Another portion of the polyvinyl alcohol solution was removed from the sheet by bringing it into contact with a periphery surface of a suction drum. Thereafter, the sheet was dried so that it could be impregnated with 1% of the dry polyvinyl alcohol based on the weight of the sheet. The sheet was then immersed in a solution of 10% by weight of a polyurethane in dimethylformamide, squeezed with a mangle and was then immersed in a water bath so as to coagulate the polyurethane in an amount of 30% based on the weight of the sheet. The sheet was dried, and a surface thereof was buffed. A suede-like sheet was obtained which had the following properties.

| | |
|---|---|
| Proportion by weight of polyurethane to non-woven fabric | 30/70 |
| Weight | 250 g/m |
| Thickness | 1.1 mm |

-continued

| | |
|---|---|
| Tensile strength | 0.60 kg/mm$^2$ |
| Breaking elongation | 38% |
| Softness (Cantilever test) | 48 mm |

Comparison Example 2

Procedures identical to those of Example 7 were carried out, except that the filaments were bundled after the complete coagulation thereof and, therefore, did not adhered to each other. The filaments bundle having a denier of 10 and composed of 100 fine filaments, each having a denier of 0.1, were not wound up on a hank spool but were directly dropped onto an endless rotary wire net together with water. When the filaments came into contact with the wire net, they were separated from each other. After the needle-punching operation, it was observed that no filament bundles existed in the resultant non-woven sheet.

EXAMPLE 8

A viscose solution was extruded through a spinneret with 100 spinning orifices, into a coagulating bath of a diluted sulfuric acid aqueous solution. While the resultant filaments were in an incompletely coagulated state, the filaments were bundled with a bundling guide so as to allow them to spontaneously adhere to each other without an adhesive. The resultant filament bundle had a denier of 20 and a flexural rigidity of 100 mg/100 denier which was determined by the press-bending test. Said filament bundle was composed of 100 fine filaments each having a denier of 0.2. A tow was provided by bundling 5000 filament bundles. Said tow was immersed in a solution of 3% by weight of methylmethoxy nylon in methyl alcohol, squeezed with a mangle so that the tow was impregnated with 0.5% of the dry methylmethoxy nylon based on the weight of the tow, and dried. The tow sized above was crimped by means of a stuffing box with a crimp number of 12 crimps/inch and was then cut into pieces 5 cm long in order to provide staple fibers, each consisting of a fibrous bundle. The staple fibers were converted into a non-woven fabric having a weight of 170 g/m$^2$. The non-woven fabric was divided into three pieces and each was immersed in a solution of 20% by weight of a polyurethane in dimethylformamide, squeezed to the extent shown in Table 4, and, each was then immersed in water to coagulate the polyurethane. The resultant sheet was immersed in a boiling methyl alcohol bath for 10 minutes and then dried. A surface of the resultant leather-like sheet was buffed. Three types of suede-like sheets were obtained. The properties of said suede-like sheets are indicated in Table 4.

Table 4

| Piece No. | Proportion by weight of polyurethane to non-woven fabric | Weight (g/m$^2$) | Thickness (mm) | Tensile strength (kg/mm$^2$) | Breaking elongation (%) | Softness (Cantilever test) (mm) |
|---|---|---|---|---|---|---|
| (1) | 10/90 | 190 | 1.1 | 0.57 | 38 | 80 |
| (2) | 30/70 | 220 | 1.2 | 0.58 | 43 | 75 |
| (3) | 50/50 | 340 | 1.3 | 0.58 | 68 | 68 |

Comparison Example 3

Operations identical to those in Example 8 were carried out except that the filaments were bundled after the coagulation was completed, and, thereafter, they did not adhere to each other. The resultant bundle had a denier of 20 and a flexural rigidity of 1 mg/100 denier and was composed of 100 fine filaments, each having a denier of 0.2.

The filament bundle was not wound up but was directly sized with 0.5% of methyl methoxy nylon based on the weight of said filament bundle. During the sizing operation, many fine filaments were broken and many fluffs were formed thereon. Therefore, the sizing operation could not be smoothly carried out. A tow was formed by bundling 1000 threads of the sized filament bundles having a relatively small number of fluffs, was crimped by means of a stuffing box and was cut into pieces 5 cm long in order to provide staple fibers. The staple fibers were converted into a non-woven fabric having a weight of 170 g/m$^2$ by means of a carding engine, a cross layer and a needle punching machine. It was observed that no bundles existed in the resultant non-woven fabric.

The non-woven fabric was separated into three pieces and each piece was converted into a leather-like sheet by the same procedures as in Example 8. The results are indicated in Table 5.

Table 5

| piece No. | Proportion by weight of polyurethane to non-woven fabric | Weight (g/m$^2$) | Thickness (mm) | Tensile strength (kg/mm$^2$) | Breaking elongation (%) | Softness Cantilever test) (mm) |
|---|---|---|---|---|---|---|
| (1) | 10/90 | 190 | 1.1 | 0.58 | 35 | 95 |
| (2) | 30/70 | 220 | 1.1 | 0.58 | 48 | 92 |
| (3) | 50/50 | 340 | 1.3 | 0.60 | 50 | 84 |

Piece (1) has a low resiliency, and felt like conventional fabric. Piece (2) had a proper softness and was rubber sheetlike to the touch. And piece (3) had a relatively high stiffness and was rubber sheet-like to the touch. From the above, it was understood that the feel of the leather-like sheets varied according to an increase in the amount of the polyurethane applied to the non-woven fabric. That is, when the amount of the polyurethane was small, the resultant sheet felt like conventional fabric i.e., excessively soft, while if the amount of the polyurethane was increased, the sheet became more stiff and felt rubber sheet-like.

EXAMPLE 9

A chip blend was prepared from 50 parts by weight of polystyrene chips and 50 parts by weight of nylon 6 chips. Said chip blend was uniformly blended by a static mixer, melted in an extruder at a temperature of 270° C, extruded through an orifice, solidified, and drawn at a draw ratio of 1.8. A drawn monofilament having a denier of 15 was obtained. The monofilament was immersed in a hot trichloroethylene bath to completely dissolve the polystyrene moiety from the monofilament. The resultant bundle of fine nylon 6 fibers was exposed to a superheated steam atmosphere at a temperature of 150° C in order to adhere the fine nylon 6 filaments to each other without using an adhesive, while forwarding the monofilament at a velocity of 100 m/min. The resultant fine filament bundle had a flexural rigidity of 90 mg/100 denier. Said bundle was dropped onto a wire net by an air jet to produce a non-woven fabric. The resultant non-woven fabric had a weight of 250 g/m$^2$.

Said non-woven fabric was first immersed in a solution of 20% by weight of a polyurethane in dimethyl formamide and then immersed in a water bath to coagulate the polyurethane. A solution of 28% by weight of a polyurethane in dimethyl formamide was thinly coated onto a surface of the resultant leather-like sheet, with a reversing coater, and the coated sheet was immersed in a water bath to coagulate the polyurethane. The resultant leather-like sheet was provided with a grain side layer. It had the proper flexibility and the following properties.

| | |
|---|---|
| Proportion by weight of polyurethane to non-woven fabric | 60/40 |
| Weight | 650 g/m$^2$ |
| Thickness | 1.6 mm |
| Tensile strength | 0.75 kg/mm$^2$ |
| Breaking elongation | 65% |
| Softness (Cantilever test) | 12 mm. |

EXAMPLE 10

Figure 14:
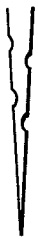
Figure 15:
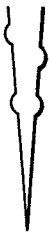

A cellulose solution was prepared by a cuprammonium process and extruded through a spinneret with 1000 spinning orifices, into a coagulating water bath. Before the coagulation was completed, the resultant filaments were bundled with a bundling guide, and thereby causing them to adhere to each other without using an adhesive. The filament bundle thus prepared was dropped onto an endlessly circulating wire net by a water jet, in order to form a non-woven fabric. A portion of the filament bundle was wound up onto a hank spool and subjected to the press-bending test. As a result, the flexural rigidity of the bundle was 250 mg/100 denier. The non-woven fabric prepared above was dried in a box-type tunnel dryer at a temperature of 100° C. The dried sheet was pressed between a pair of pressing drums at a temperature of 150° C under a pressure of 10 kg/cm$^2$. The surface of the sheet become flat. However, many small protuberances and cavities formed by the entanglement and intertwining of the filament bundles, with each other, were observed on the surface of the sheet. The flattened sheet was needle-punched by a needle as indicated in FIG. 14 at a rate of 2500 times/inch. The larger the needling number, the smoother the sheet surface. It was observed that during the needle-punching operation, the individual filaments were separated from the bundle by the action of the needle, but the bundle itself was not substantially broken.

The non-woven fabric thus prepared was immersed in an aqueous solution of 10% by weight of a polyvinyl alcohol, squeezed with a mangle to such an extent that the non-woven fabric was impregnated with 150% of the solution based on the weight of the fabric, and then dried at a temperature of 100° C. The non-woven fabric was then immersed in a solution of 20% by weight of a polyurethane in dimethylformamide, squeezed with a mangle to such an extent that the fabric was impregnated with 400% of the solution based on the weight of the fabric, and was then treated with steam for 1 minute. Thereafter, the fabric was immersed in a mixture solution bath consisting of 50 parts by weight of water and 50 parts by weight of dimethylformamide to incompletely coagulate the polyurethane, was squeezed with a mangle, was again immersed in a water bath to completely coagulate the polyurethane, and was then dried. The resultant leather-like sheet was adjusted to a thickness of 1.5 mm by slicing the outer surface layers with a slicer. The sliced sheet had a weight of 145 g/m². A solution of 30% of a polyurethane in dimethyl formamide was coated onto the sliced outer surface of the sheet, and the sheet thus coated was immersed in a water bath to coagulate the polyurethane coating. Finally, the leather-like sheet with a grain side layer was treated with a hot water bath at a temperature of 90° C for 1 hour to remove the polyvinyl alcohol therefrom. The resultant artificial leather was provided with a grain side layer, was very soft, and was extremely useful as artificial shoe leather. Said artificial leather had the following properties.

| | |
|---|---|
| Proportion by weight of polyurethane to non-woven fabric | 25/75 |
| Weight | 200 g/m² |
| Thickness | 1.8 mm |
| Tensile strength | 0.62 kg/mm² |
| Breaking elongation | 32% |
| Softness (Cantilever test) | 40 mm |

EXAMPLE 11

Operations identical to those in Example 10 were repeated except that the non-woven fabric was not needle-punched. The resultant artificial leather was provided with a grain side layer and was flexible, but relatively stiff.

The artificial leather had the following properties.

| | |
|---|---|
| Proportion by weight of polyurethane to non-woven fabric | 25/75 |
| Weight | 200 g/m² |
| Thickness | 1.8 mm |
| Tensile strength | 0.52 kg/mm² |
| Breaking elongation | 22% |
| Softness (Cantilever test) | 10 mm |

From a comparison of the properties of the artificial leather of Example 10 with those of Example 11, it is obvious that the needle-punching operation for non-woven fabric composed of filament bundles, results in an increase in the softness of the resultant artificial leather.

The non-woven fabrics of Examples 10 and 11 were observed by a scanning electron microscope. It was found that the non-woven fabric of Example 10 contains numerous fine filaments separated from the filament bundles and has the internal structure shown in FIG. 5, whereas the non-woven fabric of Example 10 is composed of only a filament bundle which is maintained in its original configuration, and has the internal structure shown in FIG. 1.

EXAMPLE 12

A cellulose solution provided by a cuprammonium process was extruded through 2000 spinnerets each having 500 spinning orifices, into a coagulating water bath. Before the coagulation of the resultant filaments was completed, the filaments were divided into 2000 groups each consisting of 500 filaments, each group being extruded through its respective spinneret. Each groups of the filaments was bundled by a bundling guide, so as to allow the filaments to spontaneously adhere to each other without using an adhesive. After completion of the coagulation, the filaments were accumulated on a wire net of 1 m wide to form a para lay sheet. The para lay sheet was folded to form a cross lay sheet. The sheet was completely washed with water, dried and, thereafter, needle-punched using needles with the configuration shown in FIG. 16 at a rate of 2000 times/in² so as to prepare a non-woven fabric. A portion of the filament bundle was subjected to the press-bending test. As a result, it was determined that the filament bundle had a flexural rigidity of 80 mg/100 denier.

The needle-punched non-woven fabric obtained above was observed by means of a scattering electron microscope. It was found that the filament bundles were divided into small bundles each consisting of a plurality of fine filaments which adhered to each other without an adhesive or individual filaments completely separate from each other. The filament bundle was randomly broken by the needling operation so as to form cut fiber bundles.

The non-woven fabric had a weight of 300 g/m² and a thickness of 2.5 mm.

The non-woven fabric was immersed in an aqueous solution of 5% by weight of polyvinyl alcohol, squeezed by a mangle to such an extent that the fabric was impregnated with 150% of the solution based on the weight of the fabric and, then, dried at a temperature of 100° C. Thereafter, the non-woven fabric was immersed in a solution of 10% by weight of a polyurethane in dimethylformamide, squeezed by a mangle to such an extent that the fabric was impregnated with 500% of the solution based on the weight of the fabric, and immersed in a mixture solution of 50 parts by weight of water and 50 parts by weight of dimethylformamide to incompletely coagulate the polyurethane. Next, the non-woven fabric was squeezed by a mangle to remove the mixture solution, was then immersed in a water bath to completely coagulate the polyurethane, and finally, was dried. The resultant leather-like sheet had a weight of 550 g/m². The sheet was sliced by a slicer to form two pieces, and the sliced surface of the two sheets were buffed by a buffing machine. The resultant suede-like sheets had a desirable uniform look and feel to the touch, and the following properties.

| | |
|---|---|
| Proportion by weight of polyurethane to non-woven fabric | 20/80 |
| Weight | 220 g/m² |
| Thickness | 1.2 mm |
| Tensile strength | 0.68 kg/mm² |
| Breaking elongation | 31% |
| Softness (Cantilever test) | 90 mm |

EXAMPLE 13

Operations identical to those in Example 13 were repeated, except that no needle-punching operation was applied to the cross lay-like sheet. After the buffing operation, it was observed that on the buffed surface of the leather-like sheet, the end portions of the filament bundles and individual filaments were non-uniform in length and in the distribution thereof. The buffed sheet was properly flexible, and relatively stiff, and had the following properties.

| |
|---|
| Proportions by weight of polyurethane |

-continued

| | |
|---|---|
| to non-woven fabric | 20/80 |
| Weight | 220 g/m² |
| Thickness | 1.2 mm |
| Tensile strength | 0.55 kg/mm² |
| Breaking elongation | 23% |
| Softness (Cantilever test) | 40 mm |

From the fact that the leather-like sheet of Example 12 had a softness (Cantilever test) of 90 mm, while that of Example 13 was 40 mm, it is obvious that the needle-punching operation is effective in increasing the softness of the sheet. According to observation by a scattering electron microscope, the leather-like sheet of Example 12 had the internal structure indicated in FIGS. 5 and 6, while the leather-like sheet of Example 13 had the internal structure indicated in FIG. 1.

EXAMPLE 14

A cellulose solution for a cuprammonium process was extruded through 5000 spinnerets, each having 100 spinning orifices, into a water bath to produce cuprammonium rayon filaments each having a denier of 0.08. Before the filaments were completely coagulated, the filaments were divided into 5000 groups each consisting of 100 filaments, each group being extruded through its respective spinneret. Each group of the filaments was bundled by a bundling guide so as to allow the filaments to spontaneously adhere to each other without using an adhesive. After complete coagulation, the filament bundle was accumulated at random on a wire net of a 50 cm wide to form a random sheet. A portion of the filament bundle was subjected to the press-bending test. As a result, it was determined that the flexural rigidity of the filament bundle was 50 mg/100 denier. Many water jets were directed under a pressure of 50 kg/cm² to the sheet through 500 nozzles having a diameter of 0.05 mm and located at a distance of 10 cm from the sheet. After drying, the sheet was observed by a scanning electron microscope. It was found that the filament bundle in the sheet was not substantially broken by the action of the water jets, that the bundle was locally divided into small bundles and individual filaments, and that the divided small bundles or individual filaments were lightly entangled and intertwined. The internal structure of the sheet is shown in FIGS. 4 and 5. Further, it was found that the sheet was highly flexible and soft. These properties of the sheet which had been treated by the water jets, were remarkably different from those of the sheet which had not been treated by the water jets.

The random sheet was dyed in an aqueous dyeing bath containing 3% of Kayaras Supra Red 6BL (C.I. No. 29065), 5% of common salt and 1% of sodium carbonate based on the weight of the sheet, at a liquor ratio of 1:50 at the boiling temperature for 1 hour. The dyed sheet was aftertreated with an aqueous solution containing 0.2% by weight of Amigen (a cationic dye fixing agent made by Daiichi Kogyo Seiyaku Kabushiki Kaisha) for 10 minutes, washed with water, and then dried. The sheet was dyed bright red.

EXAMPLE 15

A cellulose solution for a cuprammonium process was extruded through 2000 spinnerets, each having 300 spinning orifices, into a water bath in order to produce cuprammonium rayon filaments, each having a denier of 0.1. Before the filaments were completely coagulated, the filaments were divided into 2000 groups each consisting of 300 filaments, each group being extruded through its respective spinneret. Each group of the filaments mere bundled by a bundling guide so as to allow them to spontaneously adhered to each other without using an adhesive. After the completion of the coagulation, the filament bundles prepared above were further bundled to form a tow. The tow was opened in a water bath by a mangle and immediately folded to form a sheet. After removing water from the sheet by means of a wire net, numerous water jets were directed under a pressure of 100 kg/cm² through 500 nozzles having a diameter of 0.05 mm, to the sheet at a right angle thereto.

After the completion of the drying operation, the sheet was observed in detail by means of a scattering electron microscope. It was found that the filament bundles were randomly broken by the action of the water jets, and many cut ends of the fine filaments projected from the surface of the sheet. The breakage of the filament bundles was effected at random. Some of the filament bundles were very short, for example, about 1 cm, while others looked like continuous filament. Further, it was observed that the filament bundles were locally divided into several smaller bundles or individual filaments. The filament bundles, the smaller bundles and the individual filaments were entangled and intertwined with each other thereby forming a dense non-woven fabric.

The initial filament bundles had a flexural rigidity of 25 mg/100 denier which was determined by the press-bending test.

EXAMPLE 16

A cellulose solution prepared by a cuprammonium process was extruded through 2000 spinnerets, each having 500 spinning orifices, into a water bath to produce cuprammonium rayon filaments, each having a denier of 0.1. Before the coagulation was completed, the filaments were divided into 2000 groups each consisting of 500 filaments, each group being extruded through its respective spinneret. Each group of the filaments were bundled by a bundling guide, and after the completion of said coagulation, the resultant filaments bundles were randomly placed on an endlessly circulating wire net to form a para-lay-like sheet. Then, numerous water jets were directed, under a pressure of 10 kg/cm², onto the sheet at a right angle to the sheet. By this operation, the filament bundles in the sheet were lightly entangled and intertwined with each other, and the sheet was dimensionally stabilized. The stabilized sheet was folded on the circulating wire net to form a cross-lay like sheet and numerous water jets were directed to the sheet under a pressure of 20 kg/cm², at an angle normal to the sheet, to further dimensionally stabilize the sheet by entangling and intertwining the filament bundles with each other. The sheet was dried in a tunnel type dryer at a temperature of 100° C. The dried sheet had a thickness of 5 mm, weight of 450 g/m² and a softness of 70 mm, as determined by the Cantilever test. The filament bundle had a denier of 50 and a flexural rigidity of 50 mg/100 denier, determined by the press-bending test.

The sheet was needle-punched using needles having the configuration indicated in FIG. 16 at a rate of 3000 times/in². The sheet became very soft, and flexible as a result of said needle-punching operation. The softness of the resultant sheet was 110 mm, as determined by the Cantilever test. The other properties of the sheet were as follows.

| | |
|---|---|
| Weight | 470 g/m² |
| Tensile Strength | 0.55 kg/mm² |
| Breaking elongation | 20% |

The sheet was observed in detail by a scanning electron microscope. It was found that the filament bundles were divided into individual filaments or various types of smaller bundles which were composed of, for example, 2, 3, 4 or more filaments all adhering to each other without using an adhesive. The bundles were broken at random, for example, at a length of 1 to 10 cm, by the water jets. Numerous cut ends of the filament bundles and individual filaments projecting from the surface of the sheet, were observed.

Since the sheet consisted of relatively thick filament bundles of 50 denier, the surface of the sheet was flat and smooth.

The sheet was divided by a slicer into two pieces. According to the microscopic observation of the sliced surface of the sheet, almost all of the filament bundles were divided into small bundles and individual filaments and no large bundles i.e. 50 denier, could be found. The sliced sheet was immersed in an aqueous solution of 10% by weight of a polyvinyl alcohol, squeezed, and dried. The dried sheet was further immersed in a solution of 20% by weight of a polyurethane in dimethylformamide, squeezed with a mangle, and then immersed in a water bath to coagulate the polyurethane. In order to remove the polyvinyl alcohol, the sheet was treated in a hot water bath at a temperature of 90° C for 30 minutes, and dried. The resultant leather-like sheet had a thickness of 3.7 mm and a weight of 600 mg/m². The leather-like sheet was sliced by a slicer into three pieces. Said pieces were buffed on two surfaces thereof by a buffing machine. The result was three suede-like sheets which were very soft and flexible and which had the following properties.

| | |
|---|---|
| Proportion by weight of polyurethane to non-woven fabric | 30/70 |
| Weight | 200 g/m² |
| Thickness | 1.1 mm |
| Tensible strength | 0.70 kg/mm² |
| Breaking elongation | 28% |
| Softness (Cantilever test) | 75 mm |

The suede-like sheets had the internal structure indicated in FIG. 5 in which the filament bundles were divided into small bundles and the spaces between the divided filament bundles were filled by the polyurethane.

The suede-like sheet was dyed with a dyeing aqueous solution containing 3% of Kayaras Supra Red 6BL (C.I. No. 29065), 3% of Dispersol Diazo Black B (C.I. No. 11365), 5% of common salt and 5% of Disperl TL (a trade mark of an anionic dispersing agent made by Meisei Kagaku K.K.) based on the weight of the sheet, at a liquor ratio of 1:50 and at the boiling point for 1 hour.

The sheet was uniformly dyed. The dyed sheet was left stand in a conditioning chamber at a temperature of 20° C at a relative humidity of 60% for 24 hours. It was determined that the moisture content of the sheet was 6.2 mg/cm².

For comparison, the moisture content of a commercial leather-like sheet containing therein a nylon 6 non-woven fabric as a substrate was determined. It was 0.6 mg/cm².

EXAMPLE 17

A cuprammonium cellulose solution was extruded through 2000 spinnerets, each having 100 spinning orifices, into a coagulation water bath to produce cuprammonium rayon filaments, each having a denier of 0.1. Before the coagulation was completed, the filaments were divided into 2000 groups each consisting of 100 filaments, each group being extruded through its respective spinneret. Each group of the filaments was bundled by a bundling guide, so as to allow the filaments to spontaneously adhere to each other without using an adhesive. After the completion of coagulation, the filament bundles were bundled further to provide a tow of 20,000 denier. A portion of the filament bundles was subjected to a press-bending test. It was determined that the filament bundles had a flexural rigidity of 25 mg/100 denier. The tow was cut at a length of 3 cm to form staple fibers which were suspended in water to prepare a uniform slurry. Said slurry was converted into a sheet by applying the slurry onto a peripheral surface of a rotary drum having numerous fine holes, and sucking water into the inside of the drum through said fine holes. The sucked water was then discharged out of the drum. Next, numerous water jets were directed to the sheet under a pressure of 50 kg/cm² through nozzles having a diameter of 0.05 mm at a right angle to the sheet surface. After the drying operation was completed, the sheet was observed in detail by a microscope. It was found that the fiber bundles located on the surface of the sheet were almost completely divided into individual fine fibers by the water jets, and no fiber bundle existed on the surface of the sheet. Said sheet was very soft and flexible. It was also found that almost none of the fiber bundles located inside the sheet were divided.

The above-prepared non-woven sheet had a thickness of 2.0 mm and a weight of 300 g/m². The sheet was impregnated with an aqueous solution of 10% by weight of a polyvinyl alcohol, and dried. Thereafter, the sheet was immersed in a solution of 20% by weight of a polyurethane in dimethylformamide, squeezed with a mangle and immersed in a water bath to coagulate the polyurethane. In order to remove the polyvinyl alcohol, the sheet was treated with hot water at a temperature of 90° C for 30 minutes, and dried. A surface of the sheet was buffed by a buffing machine. The resultant calf suede-like sheet had a surface on which numerous fine fibers were raised and had the following properties.

| | |
|---|---|
| Proportion by weight of polyurethane to non-woven fabric | 30/70 |
| Weight | 420 g/m² |
| Thickness | 2.0 mm |
| Tensile strength | 0.68 kg/mm² |
| Breaking elongation | 33% |
| Softness (Cantilever test) | 45 mm |

EXAMPLE 18

An cuprammonium cellulose solution was converted to cuprammonium rayon filaments each having a denier of 0.1 by extrusion through 2000 spinnerets, each having 100 spinning orifices, into a coagulating water both. Before the coagulation was completed, incompletely coagulated filaments were divided into 2000 groups each consisting of 100 filaments, each group being extruded through its respective spinneret. Each group of the filaments was bundled by a bundling guide so as to allow the filaments to adhere to each other without using an adhesive. After the completion of coagulation, the filament bundles were further bundled so as to form a tow of 20,000 denier. The filament bundle had a flexural rigidity of 50 mg/100 denier which was determined by the press-bending test.

The tow was sized by a solution of 3% by weight of methyl methoxy nylon in methyl alcohol, dried and crimped by means of a stuffing box. The crimped tow was converted into a sheet by means of a random webber. The sheet thus produced was immersed in methyl alcohol to remove the methyl methoxy nylon, and then dried. Thereafter, numerous water jets were directed under a pressure of 50 kg/cm$^2$ onto the sheet at a right angle to the sheet surface, through numerous nozzles, each having a diameter of 0.05 mm. It was found that the filament bundles located on the surface of the sheet were almost completely divided into small filament bundles and individual filaments but almost none of the filament bundles located inside the sheet were divided, in spite of the action of the water jets.

The resultant leather-like sheet was very soft and felt like calf or deer skin to the touch.

EXAMPLE 19

A cuprammonium cellulose solution was extruded through 2000 spinnerets, each having 100 spinning orifices, into a coagulating water bath to produce cuprammonium rayon filaments each having a denier of 0.2. While the coagulation was still complete, the filaments were divided into 2000 groups each consisting of 100 filaments, each group being extruded through its respective spinneret. Each group of the filaments was bundled by a bundling guide in order to allow the filaments to spontaneously adhere to each other. After the coagulation was completed, the filament bundles were randomly accumulated on a wire net 50 cm wide in order to form a non-woven sheet. It was determined by the press-bending test that the filament bundles had a flexural rigidity of 15 mg/100 denier.

The non-woven sheet prepared above was completely washed with water, dried, and needle-punched at a rate of 500 times/in$^2$. The needle-punching operation was carried out for the purpose of breaking the filament bundles and forming numerous cut ends of the filaments which will be projected from a surface of the sheet when the sheet is converted into a suede-like sheet.

Since the cuprammonium rayon filament bundles of the present example were straight and not crimped, the needlepunching operation mainly resulted in breaking the filament bundles but not in entangling or intertwining them.

Next, numerous water jets were directed from nozzles having a diameter of 0.1 mm to the non-woven sheet under a pressure of 50 kg/cm$^2$ at a right angle to the sheet surface in order to entangule and intertwine the filament bundles with each other. By this jetting operation, the filament bundles were randomly divided into individual filaments. The resultant non-woven sheet had a thickness of 0.9 mm and a density of 0.25 and had the internal structure indicated in FIG. 5.

A portion of the non-woven sheet prepared above was subjected to a test by which a proportion by weight of the individual filaments to the filament bundles in the sheet was determined. The proportion was 30/70.

The sheet was immersed in an aqueous solution of 2.0% by weight of a polyvinyl alcohol, squeezed by way of suction to remove excess solution from the sheet, and then dried. The sheet was also immersed in a solution of 20% by weight of a polyurethane in dimethyl formamide, squeezed with a mangle and then immersed in water to coagulate the polyurethane. Next, the sheet was treated with hot water at a temperature of 90° C for 30 minutes to remove the polyvinyl alcohol, and was then dried. The dried sheet was buffed by a buffing machine. A calf suede-like sheet was obtained, on the surface of which numerous fine filaments were raised. The sheet was very soft and flexible and had the following properties.

| | |
|---|---|
| Proportion by weight of polyurethane to non-woven fabric | 20/80 |
| Weight | 270g/m$^2$ |
| Thickness | 0.8mm |
| Tensile strength | 1.22kg/mm$^2$ |
| Breaking elongation | 30% |
| Softness (Cantilever test) | 72mm |

EXAMPLE 20

A cuprammonium cellulose solution was extruded through 2000 spnnerets, each having 100 spinning orifices, into a coagulating water bath to produce cuprammonium rayon filaments, each having a denier of 0.1. Before the coagulation of the filament was completed, the filaments were divided into 2000 groups each consisting of 100 filaments, each group being extruded through its respective spinneret. Each group of the filaments was bundled by a bundling guide so as to allow the filaments to spontaneously adhere to each other without adhesive. After the completion of the coagulation, the bundles were further bundled to form a tow having a denier of 20,000. The filament bundles had a flexural rigidity of 25 mg/100 denier, which was determined by the press-bending method. The tow was sized with a solution of 3% by weight of methylmethoxy nylon in methyl alcohol, and dried. The above-sized tow was crimped by a stuffing box and cut at a length of 5 cm to prepare staple fibers. Said staple fibers were converted into a nonwoven sheet by means of a carding engine, a random webber and a needle-punching machine. The sheet was immersed in methyl alcohol to remove the methylmethoxy nylon from the sheet, and dried. Thereafter, many water jets were directed onto the sheet from nozzles having a diameter of 0.05 mm under a pressure of 50 kg/cm$^2$ at an angle normal to the sheet surface. The sheet was dried in a hot air dryer at a temperature of 100° C. According to microscopic observation, the filament bundles in the sheet were randomly divided into smaller bundles having various denier and individual filaments, which are complexly entangled and intertwined with each other. That is, the sheet had the internal structure indicated in FIG. 5, a thickness of 2.5 mm and a density of 0.24. In the sheet, individual filaments and filament bundles were present in a proportion by weight of 20/80. The sheet was immersed in an aqueous solution of 2.0% by weight of a polyvinyl alcohol and the excess solution was removed from the sheet by way of suction. After the drying operation was completed, the sheet was immersed in a solution of 20% by weight of polyurethane in dimethylformamide, squeezed with a mangle, and was then immersed in water to coagulate the polyurethane. The sheet was, thereafter, treated with hot water at a temperature of 90° C for 30 minutes to remove the polyvinyl alcohol, and dried. The sheet was divided into two slices by a slicer and the sliced surface of each slice was buffed by a buffing machine. The resultant calf like sheets were very soft and flexible and were provided with a suede-like surface on which numerous fine filaments were raised. Said sheets had the following properties.

| | |
|---|---|
| Proportion by weight of polyurethane to non-woven fabric | 30/70 |
| Weight | 280g/m$^2$ |
| Thickness | 1.0mm |
| Tensile strength | 0.65kg/mm$^2$ |
| Breaking elongation | 35% |
| Softness (Cantilever test) | 70mm |

EXAMPLE 21

Procedures identical to those in Example 20 were repeated, except that the operation using the water jets was not effected so that almost all of the filament bundles in the non-woven sheet were not divided. The non-woven sheet had the internal structure indicated in FIG. 1.

The sheet was immersed in an aqueous solution of 2.0% by weight of polyvinyl alcohol. Suction was applied in order to remove excess solution from the sheet. After the sheet was dried, it was immersed in a methyl alcohol bath to remove the methylmethoxy nylon, and was dried. The sheet was then immersed in a solution of 20% of a polyurethane in dimethylformamide, squeezed with a mangle, and then immersed in water to coagulate the polyurethane. The sheet was treated with hot water at a temperature of 90° C for 30 minutes to remove the polyvinyl alcohol from the sheet. After the sheet was dried, it was divided by a slicer into two slices. The sliced surfaces were buffed by a buffing machine. The resultant leather-like sheets had the following properties.

| | |
|---|---|
| Proportion by weight of polyurethane to non-woven fabric | 35/65 |
| Weight | 285g/m$^2$ |
| Thickness | 1.0mm |
| Tensile strength | 0.45kg/mm$^2$ |
| Breaking elongation | 65% |
| Softness (Cantilever test) | 55mm |

Although the sheets had a desirable feel to the touch, the tensile strength thereof was relatively low.

EXAMPLE 22

A cuprammonium cellulose solution was extruded through 2000 spinnerets, each having 500 spinning orifices, into a coagulation water bath so as to produce cuprammonium rayon filaments, each having a denier of 0.1. Before the coagulation was completed, the filaments were divided into 200 groups each consisting of 500 filaments, each group being extruded through its respective spinnerets. Each group of the filaments was bundled by a bundling guide so as to allow the filaments to spontaneously adhere to each other. The filament bundles were accumulated on a circulating wire net to form a para-lay non-woven sheet. Numerous water jets were directed onto said non-woven sheet through nozzles having a diameter of 0.1 mm under a pressure of 15 kg/cm$^2$ at a right angle to the sheet surface, so as to allow the filaments bundles to become lightly entangled and intertwined with each other. The para-ray sheet was converted into a cross-lay non-woven sheet by folding the para-ray sheet and placing the folded sheet onto another circulating wire net.

The filament bundle had a flexural rigidity of 20 mg/100 denier which was determined by the press-bending test.

After the sheet was dried, it was needle-punched at a rate of 1000 times/in$^2$ so that the filament bundles were broken at random.

The sheet was subjected to a treatment in which many jets of water were directed onto the sheet throgh nozzles having a diameter of 0.1 mm under a pressure of 30 kg/cm$^2$ at a right angle to the sheet surface. Then, many more water jets were directed onto the sheet through nozzles having a diameter of 0.05 mm under a pressure of 45 kg/cm$^2$ at a right angle to the sheet surface. Further, still other jets of water were directed onto the sheet through nozzles having a diameter of 0.05 mm, under a pressure of 65 kg/cm$^2$ at a right angle to the sheet surface. The sheet was dried in a hot air drier at a temperature of 100° C. The resultant non-woven sheet had a thickness of 0.9 mm, a density of 0.27 and the internal structure indicated in FIG. 6, in which structure the filament bundles and individual filaments were entangled and intertwined with each other.

It was determined that the proportion by weight of the individual filaments to the filament bundles in the sheet was approximately 65/35.

The non-woven sheet was immersed in an aqueous solution of 2.0% by weight of a polyvinyl alcohol, followed by the removal of excess by way of suction, after which the sheet was direct. Thereafter, the sheet was immersed in a solution of 20% by weight of a polyurethane in dimethylformamide, squeezed by a mangle, and then immersed in a water bath to coagulate the polyurethane. Next, the sheet was treated with hot water at a temperature of 90° C for 30 minutes to eliminate the polyvinyl alcohol from the sheet. Finally, the resultant leather-like sheet was converted into a calf suede-like sheet by buffing a surface of the sheet with a buffing machine. Said calf suede-like sheet was provided with a surface on which the fine individual filaments were raised. Said sheet was very soft and flexible and had the following properties.

| | |
|---|---|
| Proportion by weight of polyurethane to non-woven fabric | 30/70 |
| Weight | 250g/m$^2$ |
| Thickness | 0.7mm |
| Tensile strength | 0.96 kg/mm$^2$ |
| Breaking elongation | 28% |
| Softness (Cantilever test) | 87mm |

Comparison Example 4

A cuprammonium cellulose solution was extruded through 2000 spinnerets, each having 500 spinning orifices, into a coagulating water bath the produce cuprammonium rayon filament, each having a denier of 0.2. In the above process, no bundling operation was applied to the extruded filaments before the coagulation was completed. The filaments were dropped onto a circulating wire net to form a para-lay non-woven sheet. Many water jets were directed onto said para-lay sheet at a pressure of 15 kg/cm$^2$ at a right angle to the sheet surface so as to allow the filaments to become lightly entangled and intertwined with each other. By the above operation, the para-lay sheet was dimensionally stabilized. The sheet was accumulated on an another circulating wire net in a folded form, so as to prepare a cross-lay non-woven sheet, and was dried. The dried sheet was subjected to a needle-punching operation at a rate of 1000 times/in$^2$. By the above operation, the filaments were broken at random. Next, many jets of water were directed onto the sheet through nozzles having a diameter of 0.1 mm, under a pressure of 30 kg/cm$^2$ at a right angle to the sheet surface. The sheet was then dried in a hot air dryer at a temperature of 100° C. A non-woven fabric having a thickness of 0.7 mm and a density of 0.20 was obtained. According to microscopic observation, the sheet had the internal structure shown in FIG. 7, in which individual fine filaments were entangled and intertwined with each other and in which no filament bundles could be found.

The above-obtained sheet was first impregnated with the polyvinyl alcohol, and then with the polyurethane by the same method as in Example 23. Thereafter, the polyvinyl alcohol was eliminated from the sheet by the same method as in Example 23. After the sheet was dried, the buffing operation was applied to the dried sheet.

The resultant sheet felt like paper but did not feel like leather to the touch.

EXAMPLE 23

A cuprammonium cellulose solution was extruded through 2000 spinnerets, each having 100 spinning orifices, into a coagulating water bath so as to produce cuprammonium rayon filaments, each having a denier of 0.08. Before the coagulation was completed, the filaments were divided into each group consisting 2000 groups each consisting of 100 filaments, each group being extruded through its respective spinneret. Each group of the filaments was bundled by a bundling guide so as to allow the filaments to spontaneously adhere to each other. After the coagulation was completed, the filament bundles were bundled together to form a tow of 16,000 denier. Said filament bundles has a flexural rigidity of 20 mg/100 denier, which was determined by the press-bending test. The tow was cut to form staple fibers having a length of 3 cm. Said staple fibers were suspended in water to form a slurry. The slurry was applied onto a peripheral having numerous small holes of a rotating suction drum and, through said small holes, water in the slurry was sucked into the inside of the drum and discharged out of the drum so as to form a non-woven fabric on the periphery of said drum.

Numerous jets of water were directed onto the non-woven fabric through nozzles having a diameter of 0.05 mm, under a pressure of 50 kg/cm$^2$ at a right angle to the sheet surface, and the sheet was then dried in a hot air dryer.

The resultant non-woven sheet had a thickness of 1.0 mm and a density of 0.25. According to microscopic observation, the internal structure of the sheet was like the structure indicated in FIG. 5 wherein the filament bundles and individual filaments were entangled and intertwined with each other. Using a portion of the sheet, it was determined that the individual filaments and the filament bundles existed in a proportion by weight of 35/65.

The non-woven sheet was immersed in an aqueous solution of 2.0% by weight of a polyvinyl alcohol. After excess solution was eliminated from the sheet by way of suction, the sheet was dried. Next, the sheet was immersed in a solution of a polyurethane in dimethylformamide, squeezed with a mangle, and then immersed in a water bath to coagulate the polyurethane. The sheet was further immersed in boiling water for 30 minutes to eliminate the polyvinyl alcohol, and was dried. Finally, a surface of the sheet was buffed by a buffing machine so as to raise the fine filaments located on the surface of the sheet. The resultant leather-like sheet was very soft and flexible and felt like calf skin. Said leather-like sheet had the following properties.

| | |
|---|---|
| Proportion by weight of polyurethane to non-woven fabric | 35/65 |
| Weight | 225g/m$^2$ |
| Thickness | 0.8mm |
| Tensile strength | 0.60kg/mm$^2$ |
| Breaking elongation | 30% |
| Softness (Cantilever test) | 80 mm |

EXAMPLE 24

A cuprammonium cellulose solution was extruded through a spinneret having 500 spinning orifices into a coagulating water bath to produce cuprammonium rayon filaments, each having a denier of 0.2. While the filaments were incompletely coagulated, they were bundled by a bundling guide so as to form a filament bundle wherein the filaments were spontaneously adhered to each other. After the coagulation was completed. The filament bundle was cross wound up onto a frame having a diameter of 1 m using a traverse guide at a cross angle ($\alpha$) of 85 degrees. When the filament bundle formed a layer of 0.8 mm thick on the frame, the winding up operation was stopped. The layer was cut along the longitudinal axis of the frame and opened. A sheet having the structure indicated in FIG. 18, was obtained. The filament bundle had a flexural rigidity of 25 mg/100 denier which was determined by the press-bending test.

The sheet was subjected to a needle-punching operation at a rate of 1000 times/in$^2$. It was observed that by the needle-punching operation, the filament bundles were broken at random but almost all of them did not entangle with each other. Next, the sheet was treated by the method wherein numeroud water jets were directed onto the sheet through 1000 nozzles 0.1 mm in diameter, under a presssure of 50 kg/cm$^2$, at a right angle to the sheet surface. After the sheet was dried, microscopic observation was performed. It was found that the filament bundles were divided into small bundles and individual filaments, and that they were entangled and intertwined with each other. That is, the sheet had the internal structure indicated in FIG. 4.

The sheet was immersed in a solution of 10% by weight of a polyurethane in dimethylformamide, squeezed with a mangle, was immersed in water to coagulate the polyurethane, and was then dried. Finally, the sheet was buffed. The resultant suede-like sheet was very soft and flexible and had the following properties.

| | |
|---|---|
| Proportion by weight of polyurethane to non-woven fabric | 40/60 |
| Weight | 250g/m$^2$ |
| Thickness | 0.8mm |
| Tensile strength | 0.78kg/mm$^2$ |
| Breaking elongation | 27% |

-continued

| | |
|---|---|
| Softness (Cantilever test) | 70mm |

EXAMPLE 25

A cuprammonium cellulose solution was extruded through 2000 spinerets, each having 100 spinning orifices, into a coagulation water bath to produce cuprammonium rayon filaments having a denier of 0.1. While the filaments were incompletely coagulated, the filaments were divided into 2000 groups each consisting of 100 filaments, each group being extruded through its respective spinneret. Each group of the filaments was bundled so as to form a filament bundle wherein the filaments were spontaneously adhered to each other, and was then completely coagulated.

The filament bundle had a flexural rigidity of 80 mg/100 denier which was determined by the press-bending test.

The filament bundle was cross-wound up by using the device shown in FIG. 18, at a cross angle of 105°. When said filament bundle was formed into a layer 25 mm thick, the winding operation was terminated. The layer was cut along the longitudinal axis of the device and opened to form a flat sheet. The sheet was treated by the method wherein numerous jets of water were successively directed onto the sheet, under pressures of 10, 50, 70 and 150 kg/cm$^2$ respectively, through nozzles having a diameter of 0.1 mm at a right angle to the sheet surface. Thereafter, the resultant non-woven sheet was dried. According to detailed microscopic observation, it was found that the filament bundles were broken at random and divided into small bundles and individual filaments and that they were entangled and intertwined with each other. That is, the sheet had the internal structure indicated in FIG. 6, and was soft and flexible.

The non-woven sheet was immersed in a solution of 25% by weight of a polyurethane in dimethylformamide, squeezed with a mangle, immersed in water to coagulate the polyurethane and dried. The dried sheet was then buffed. The resultant sheet looked like suede and had the following properties.

| | |
|---|---|
| Proportion by weight of polyurethane to non-woven fabric | 30/70 |
| Weight | 300g/m$^2$ |
| Thickness | 1.2mm |
| Tensile strength | 0.74kg/m$^2$ |
| Breaking elongation | 31% |
| Softness (Cantilever test) | 65mm |

EXAMPLE 26

A cuprammonium cellulose solution was extended through 2000 spinnerets, each having 500 spinning orifices, into a coagulation water bath to produce cuprammonium rayon filaments, each having a denier of 0.1. While the filaments were incompletely coagulated, the filaments were divided into 2000 groups each consisting of 500 filaments, each group being extruded through its respective spinneret. Each group of the filaments was bundled to form a filament bundle while allowing the filaments to spontaneously adhere to each other. Thereafter, the filament bundles were completely coagulated. The resultant filament bundles had a flexural rigidity of 20 mg/100 denier which was determined by the press-bending test. The filament bundles were cross-wound up by the devide indicated in FIG. 18 at a cross angle of 90 degrees and, simultaneously with the above operation, numerous jets of water were directed onto a layer composed of the wound up filament bundles through nozzles having a diameter of 0.1 mm under a pressure of 20 kg/m$^2$, at a right angle to the layer surface. The layer was removed from the device and dried. A non-woven sheet was obtained. The sheet was needle-punched at a rate of 2000 times/cm$^2$, and thereafter, was subjected to a treatment in which numerous water jets were ejected toward the sheet through nozzles having a diameter of 0.05 mm, under a pressure of 80 kg/cm$^2$, at a right angle to the sheet surface. After the resultant non-woven sheet was dried, detailed microscopic observation was applied to the sheet. As a result, it was found that the filament bundles were broken at random and divided into small bundles and individual filaments and that they were entangled and intertwined with each other.

The non-woven sheet was immersed in a solution of 10% by weight of a polyurethane in dimethylformamide, squeezed with a mangle, immersed in water to coagulate the polyurethane, and was then dried. The sheet was buffed so as to convert it into asuede-like sheet. The resultant sheet was very soft and flexible and had the following properties.

| | |
|---|---|
| Proportion by weight of polyurethane to non-woven fabric | 30/70 |
| Weight | 250g/m$^2$ |
| Thickness | 1mm |
| Tensile strength | 0.96kg/mm$^2$ |
| Breaking elongation | 50% |
| Softness (Cantilever test) | 73mm |

EXAMPLE 27

An islands-in-a-sea type composite filament composed of 60% by weight of a sea constituent consisting of polystyrene (Stylon G P679, a trademark of Asahi Dow Co., Ltd., Japan) and 40% by weight of Nylon 6 as island constituents having a relative sulfuric acid viscosity ($\eta r$) of 3.2 was prepared by a melt-spinning process. The resultant composite filament having a denier of 40 was immersed in a chloroform bath at a temperature of 50° C for 30 minutes to dissolve away the polystyrene sea constituent and form a bundle of 50 nylon 6 fine filaments. The nylon 6 filaments had a denier of 0.3, and were independent from each other. Accordingly, the filaments could be easily divided from the bundle. The nylon 6 filament bundle was caused to travel through a steam box into which steam having a pressure of 3.0 kg/cm$^2$ was jetted. The nylon 6 filaments spontaneously adhered to each other. The filament bundle had a flexural rigidity of 90 mg/100 denier, which was determined by the press-bending test.

The nylon 6 filament bundle was cross-wound up by hand to form a sheet such as the one indicated in FIG. 18. The shee had a weight of 18 g/m$^2$. 12 piece of these sheets were superimposed on each other, and were then converted into a non-woven sheet by the same method as that in Example 27, including the needle-punching and the high pressure water jetting operations.

According to scanning electron microscopic observation, the filament bundles in the sheet were broken and divided into small bundles consisting of, for example 6, 15 or 27 filaments, and they were entangled and intertwined with each other. Further, it was observed that the individual filaments filled to spaces formed between the filament bundles and that the small filament bundles were entangled with each other. That is, the sheet had both of the internal structures indicated in FIGS. 5 and 6. The sheet had a weight of 197 g/m$^2$ and a thickness of 1.2 mm and was soft and bulky.

The sheet was immersed in a solution of 15% by weight of a polyurethane in dimethylformamide, squeezed with a mangle, immersed in water to coagulate the polyurethane, dried and, thereafter, was buffed.

The result was a leather-like sheet having a suede-like surface on which the fine nylon 6 filaments were raised. The suede-like shet was very soft and flexible and had a high elasticity along the thickness thereof, together with the following properties.

| | |
|---|---|
| Proportion by weight of polyurethane to non-woven fabric | 35/60 |
| Weight | 285g/m$^2$ |
| Thickness | 1.1mm |
| Tensile strength | 1.03kg/mm$^2$ |
| Breaking elongation | 42% |
| Softness (Cantilever test) | 76mm |

Comparison Example 5

The same islands-in-a-sea type composite filament as used in Example 27 was cross-wound up by the same method as in Example 27. A sheet having the structure indicated in FIG. 18, was obtained. Said sheet was treated with the high pressure water jets and was needle-punched by the same methods as those in Example 27, in order to prepare a non-woven sheet. Said non-woven sheet was immersed ina chloroform bath at a temperature of 50° C for 30 minutes to eliminate the polystyrene constituent from the filament. The resultant sheet was composed of only nylon 6 filament bundles, each composed of 50 fine filaments of 0.3 denier which were separate from each other. As a result of scanning electron microscopic observation, it was found that the filament bundles were not broken by the high pressure water jetting and the needle-punching operations.

The non-woven sheet was stiffer than that of Example 28 and poor in bulkiness. Further, it was observed that the surface of the sheet was very poor in both smoothness and softness to the touch.

The sheet was impregnated with the polyurethane and was buffed by the same methods as in Example 27. The resultant product had the appearance of suede-like artificial leather. However, the fluffs formed on the buffed surface of the sheet were too thick, whereas the fluffs on the buffed surface of the sheet of Example 28 looked like very thin downy hairs. Further, the sheet was poor in flexibility and elasticity along the thickness thereof, and had the following properties.

| | |
|---|---|
| Proportion by weight of polyurethane to non-woven fabric | 32/68 |
| Weight | 270g/m$^2$ |
| Thickness | 0.7mm |
| Tensile strength | 0.48kg/mm$^2$ |
| Breaking elongation | 62% |
| Softness (Cantilever test) | 57mm |

It should be noted that the tensile strength of the present comparison example is remarkably lower than that of Example 28. This is derived from the fact that since the filament bundles in the sheet of the present comparison example were not divided, the bundles could not be satisfactorily entangled and intertwined with each other. Accordingly, the present sheet had a relatively large breaking elongation and slippage between the filament bundles frequently occurred. This results in a sheet having a low elasticity and a poor recovery from deformation.

Comparison Example 6

Procedures identical to those in Example 27 were carried out, except that the steaming operation for adhering the nylon 6 filaments to each other were omitted. The resultant nylon 6 filament bundles had filaments which were separate from each other. After the high pressure water jetting and needle-punching operation were applied to the non-woven sheet, it was found that the resultant product which had a weight of 192 g/m$^2$, had the internal structure indicated in FIG. 7, wherein no filament bundle was found. The resultant sheet was extremely soft and poor in bulkiness, and, therefore, was not suitable as artificial leather.

In the operation for treating the sheet with the polyurethane solution, it was found that the sheet could not be impregnated with the necessary amount of the solution, due to the poor bulkiness thereof. After the coagulation of the polyurethane was completed, the sheet was buffed. However, since the surface of the sheet was coated by a too small amount of the polyurethane, the filaments located on the surface of the sheet were excessively raised. Therefore, the resultant product looked like a blanket rather than suede. The product had the following properties.

| | |
|---|---|
| Proportion by weight of polyurethane to non-woven fabric | 15/85 |
| Weight | 225g/m$^2$ |
| Thickness | 0.4mm |
| Tensile strength | 0.64kg/mm$^2$ |
| Breaking elongation | 32% |
| Softness (Cantilever test) | 75mm |

From the above properties, it is obvious that the thickness and weight of the product of the present comparison example were remarkably smaller than those of Example 27. This is due to the fact that the non-woven sheet of the present comparison example is very poor in its capacity for being impregnated with the polyurethane solution.

What we claim is:

1. A non-woven fabric usable as a substratum sheet of artificial leathers, comprising numerous fibrous bundles, each comprising a plurality of extremely fine filaments or fibers having a denier of 0.005 to 0.5 and spontaneously adhered to each other side-by-side without using an adhesive, a portion of said fibrous bundles being divided into thin fibrous bundles and individual filaments or fibers, said thin fibrous bundles, said individual filaments or fibers and the remaining fibrous bundles being entangled with each other to form a body of non-woven fabric.

2. A non-woven fabric as claimed in claim 1, to which each fibrous bundle comprises regenerated cellulose rayon filaments or fibers.

3. A non-woven fabric as claimed in claim 2, in which said regenerated cellulose rayon is cuprammonium rayon.

4. A non-woven fabric as claimed in claim 2, in which said regenerated cellulose rayon is viscose rayon.

5. A non-woven fabric as claimed in claim 3, in which said cuprammonium rayon fibrous bundle has a flexural rigidity of 15 to 500 mg/100 denier.

6. A non-woven fabric as claimed in claim 1, in which each fibrous bundle comprises a synthetic polymer filament or fibers.

7. A non-woven fabric as claimed in claim 1, in which the sum weight of the individual filaments or fibers and the thin fibrous bundles, each composed of 5 individual filaments or fibers or less, is in an amount of 5 to 95% by weight.

8. An artificial leather comprising a non-woven fabric impregnated with an elastic synthetic polymer, said non-woven fabric comprising numerous fibrous bundles, each comprising a plurality of extremely fine filaments or fibers having a denier of 0.005 to 0.5 spontaneously adhered to each other side-by-side without using an adhesive, a portion of said fibrous bundles being divided into thin fibrous bundles and individual filaments or fibers, said thin fibrous bundles, said individual filaments or fibers and the remaining fibrous bundles being entangled with each other to form a body of non-woven fabric.

* * * * *

UNITED STATES PATENT AND TRADEMARK OFFICE

CERTIFICATE OF CORRECTION

PATENT NO. : 4,107,374

DATED : August 15, 1978

INVENTOR(S) : Tetsuhiro Kusunose et al

It is certified that error appears in the above-identified patent and that said Letters Patent are hereby corrected as shown below:

First page of Specification after last page of drawings insert after item [22]

-- [30] FOREIGN APPLICATION PRIORITY DATA
Sept. 13, 1974 Japan.....104855/74
Aug. 8, 1975 Japan..... 95752/75 --.

Signed and Sealed this

Thirteenth Day of March 1979

[SEAL]

*Attest:*

RUTH C. MASON
*Attesting Officer*

DONALD W. BANNER
*Commissioner of Patents and Trademarks*